US005336588A

United States Patent [19]

Ueda

[11] Patent Number: 5,336,588

[45] Date of Patent: Aug. 9, 1994

[54] SOLID PHOTOGRAPHIC COLOR DEVELOPING COMPOSITION FOR SILVER HALIDE COLOR PHOTOGRAPHIC LIGHT-SENSITIVE MATERIAL

[75] Inventor: Yutaka Ueda, Hino, Japan

[73] Assignee: Konica Corporation, Tokyo, Japan

[21] Appl. No.: 119,029

[22] Filed: Sep. 9, 1993

[30] Foreign Application Priority Data

Sep. 22, 1992 [JP] Japan ..... 4-253076

[51] Int. Cl.[5] ..... G03C 7/407

[52] U.S. Cl. ..... 430/465; 310/486; 310/490

[58] Field of Search ..... 430/465, 485, 486, 490, 430/493

[56] References Cited

U.S. PATENT DOCUMENTS 3,981,732 9/1976 Emoto et al. ..... 430/465
4,985,347 1/1991 Fujimoto et al. ..... 430/393
5,273,865 12/1993 Loiacono et al. ..... 430/490

FOREIGN PATENT DOCUMENTS 1548123 11/1968 France .
172341 6/1992 Japan .

*Primary Examiner*—Hoa Van Le
*Attorney, Agent, or Firm*—Jordan B. Bierman

[57] ABSTRACT

Disclosed is a solid photographic color developing composition comprising a photographic color developing agent and at least one of monosaccharides.

9 Claims, 3 Drawing Sheets

SOLID PHOTOGRAPHIC COLOR DEVELOPING COMPOSITION FOR SILVER HALIDE COLOR PHOTOGRAPHIC LIGHT-SENSITIVE MATERIAL

FIELD OF THE INVENTION

The present invention relates to a silver halide color photographic light-sensitive material processing agent, more specifically a solid photographic color developing composition for silver halide color photographic light-sensitive material (hereinafter also referred to as "light-sensitive material") and a method of processing a silver halide color photographic light-sensitive material therewith.

BACKGROUND OF THE INVENTION

Processing a light-sensitive material basically comprises two processes: a color developing process and a desilvering process. The desilvering process comprises either a bleaching process and fixing process or a bleach-fixing process. Additionally, rinsing, stabilizing and other processes may be added.

In color development, an aromatic primary amine developing agent, oxidized simultaneously with reduction of exposed silver halide to silver, reacts with a coupler to form a dye. In this process, halogen ions resulting from silver halide reduction are dissolved and accumulated in the developer, while the color developing agent is consumed or accumulated in the light-sensitive material and carried away, its concentration decreasing. For this reason, in a processing method wherein a large amount of light-sensitive material is continuously processed using an automatic processing agent etc., a means of keeping the color developer component concentrations within a given range to avoid fluctuation in finish properties due to component concentration change. For this purpose, it is a common practice to supply a replenisher for supplementing lacking components and diluting unnecessary increment components. This replenishment always results in a large amount of overflow, which is then disposed of, thus posing a major problem both economically and environmentally. In these situations, there have recently been proposed and brought into practical application various methods for overflow volume reduction, such as those of developer regeneration by use of ion exchange resin or electrodialysis, those of replenishment with dense replenishers at low replenishing rates and those of recycled use of overflow as a replenisher by addition of regenerating agents.

Developer regeneration is achieved by removing undesirably accumulated bromides and compensating lacking components. This method, based on use of ion exchange resin or electrodialysis, is faulty that unless the developer components are monitored and quantitatively kept constant by chemical analysis, the processing properties of the light-sensitive material are damaged. With this drawback, this method requires so troublesome management that its introduction to small-scale laboratories having no special skill, such as mini-laboratories, is almost impossible. Another drawback is very high initial cost.

Moreover, recycled use of overflow as a replenisher by addition of a regenerating agent requires additional space such as that for a stock tank, though no special skill is required, and it is troublesome for photographic processing laboratories. With these drawbacks, this method is very difficult to introduce to mini-laboratories etc. In contrast, replenishment with dense replenishers at low replenishing rates is very suitable to small-scale photographic processing laboratories such as mini-laboratories because it requires no additional special equipment and because processing management is easy. However, even this method has some drawbacks.

When preparing a dense replenisher using 4-amino-N-ethyl-N-(β-methanesulfonamidoethyl)-m-toluidine sesquisulfate monohydrate, in particular, as a color developing agent, there is a problem of clogging in the filter on the color developer tank solution circulatory line, replenisher pump damage, etc., for example, as a result of color developing agent precipitation in case of erroneous dissolution of the color developing agent with a small amount of water (miss-dissolution of replenisher), because the solubility of the color developing agent is low.

Also, because replenisher retention in the replenisher tank increases as the replenishing rate decreases, the replenisher is very susceptible to air oxidation in the replenisher tank, leading to deterioration of processing performance. As the number of mini-laboratories of low throughput is increasing with the recent growth of mini-laboratory photographic processing market, deterioration of replenisher storage stability in the replenisher tank is problematic.

Moreover, since environmental contamination is of major concern on a global scale, disposal of plastic bottles for photographic processing agents is posing a difficult problem. Accordingly, there is a strong trend toward legal regulation of use of such plastic bottles, including recommendations of recycled use, prohibition of their use, and mandatory use of biodegradable plastic materials.

As a solution to these problems, the specification for EP-456220 discloses powdering a processing agent. However, this approach is faulty that there occur solubility loss due to casing, fatigue coloring associated with moisture, oxygen, etc., in storage. Also, airborne dust inhalation by dissolution operators is very likely, representing a potential hazard to operators' health and posing a problem of contamination of other photographic processing solutions with processing agent components. To overcome this problem, there have been proposed a number of methods for granulating a photographic processing agent to a granular mixture in Japanese Patent O.P.I. Publication Nos. 109042/1990, 109043/1990 and 393735/1990 and U.S. Pat. No. 2,843,484. Despite this, the scope of chemicals suitable for powdering or granulation remains quite restricted because of various problems such as those concerning occupational safety and hygiene associated with airborne chemical dust, contamination of other kinds of processing solutions as impurities, and hindrance of preparation operation by the casing phenomenon, in which the chemical sediments and aggregates on the container bottom at dissolution, powder coating with wet coat resulting in dissolution failure.

To obtain a preferable form of processing agent utilizing these advantages of dryness, tableting has been proposed in Japanese Patent O.P.I. Publication No. 61837/1976 and other publications.

Although this method is very useful from the viewpoint of occupational safety and hygiene because of freedom from chemical scattering, it is not the best method, since it requires a complex apparatus for tablet addition to the tank because the tablets are supplied in a plurality of parts. Also, the color developing tablets described in the above publication, which incorporate hydroxylamine as a preservative, are very weak to humidity. For example, in the rainy season, the tablet surface absorbs atmospheric moisture, causing a reaction in the tablets, resulting in deteriorated storage stability and solubility, which in turn lead to insufficient photographic performance.

With these in mind, the present inventors made investigations, and found that a solid photographic processing agent comprising a number of parts and free from the above problems can be obtained by containment of a monosaccharide.

SUMMARY OF THE INVENTION

It is an object of the present invention to improve solid processing agent storage stability. It is another object of the invention to improve solid processing agent solubility. It is still another object of the invention to provide a solid processing agent free from staining in photographic processing. It is yet another object of the invention to provide a solid processing agent offering improved photographic performance stability in photographic processing. It is still yet another object of the invention to provide a silver halide color photographic light-sensitive material solid processing agent improved as to socio-environmental conservation quality and a method of processing a silver halide color photographic light-sensitive material with said processing agent.

The above objects of the present invention are accomplished by the following:

(1) A solid color developing composition for silver halide color photographic light-sensitive material containing at least one monosaccharide.

(2) The solid color developing composition of term (1) above in the form of tablets, granules or powder.

(3) The solid photographic color developing composition of term (1) or (2) above in the form of tablets.

(4) The solid photographic color developing composition of any one of terms (1) through (3) above consisting of a single agent.

(5) The solid photographic color developing composition of any one of terms (1) through (4) above containing substantially no hydroxylamine salt.

(6) The solid photographic color developing composition of any one of terms (1) through (5) above containing a p-phenylenediamine type color developing agent in a weight ratio of not lower than 10%.

(7) The solid photographic color developing composition of term (6) above wherein said p-phenylenediamine color developing agent is 4-amino-N-ethyl-N-(β-methanesulfonamidoethyl) -m-toluidine sesquisulfate hydrate.

(8) The solid photographic color developing composition of any one of terms (1) through (7) above containing a p-phenylenediamine color developing agent whose concentration in a solution of said solid photographic color developing composition is at least $1.5\times10^{-2}$ mol/l.

(9) A method of continuously processing a silver halide color photographic light-sensitive material, after imagewise exposure, using an automatic processing machine, wherein the solid photographic color developing composition of any one of terms (1) through (8) above is added to a portion in contact with the color developer and dissolved when replenishing the color developer bath.

Figure 1:
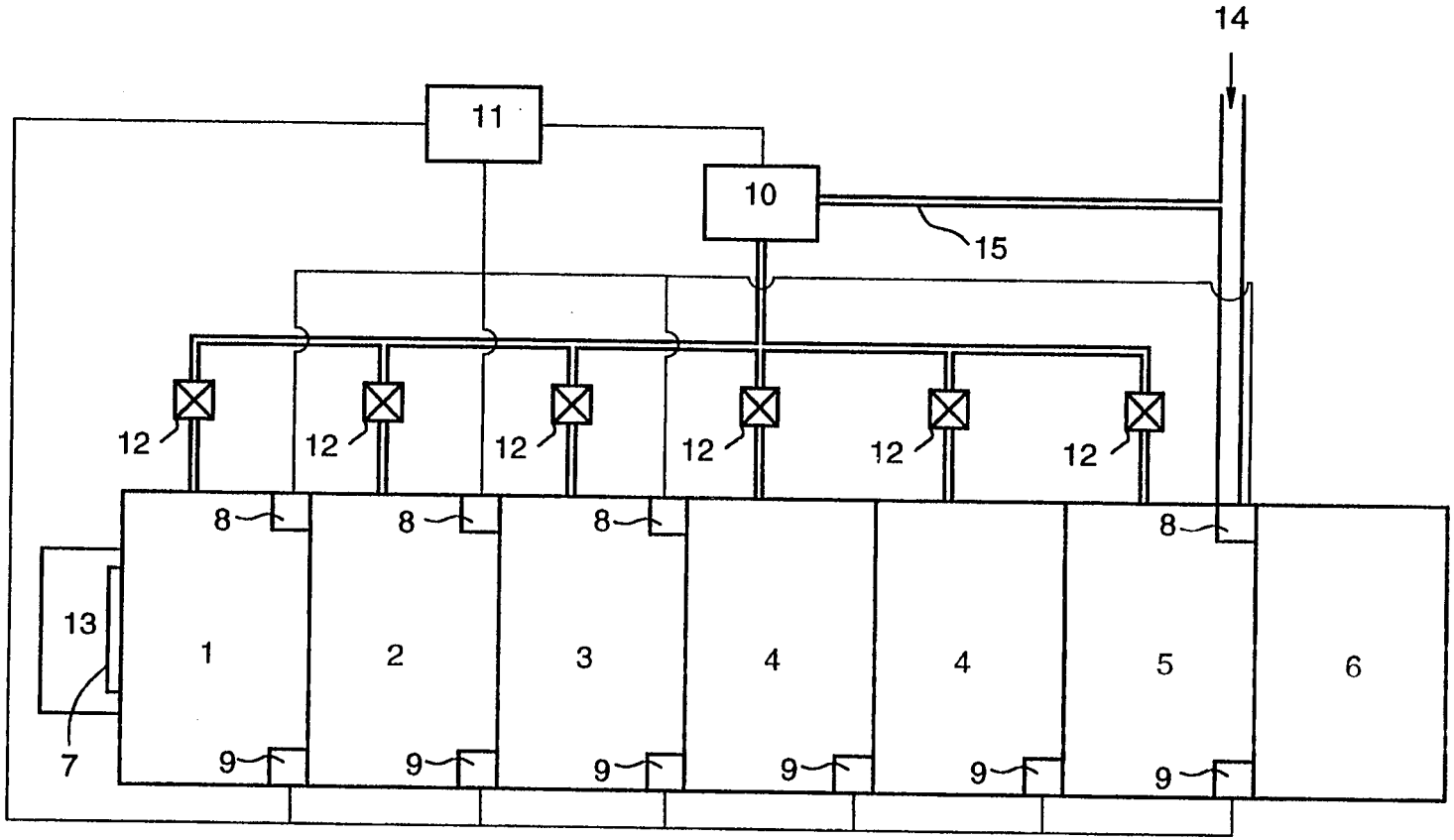
FIG. 1 is a schematic diagram showing an example automatic processing machine used for the processing method of the present invention.

In these figures, the numerical symbols have the following definitions:

1: Color developer bath
2: Bleacher bath
3: Fixer bath
4: Washing bath
5: Stabilizer bath
6: Drying portion
8: Replenishing agent supplier
10: Replenishing water supplier
16: Processing tank
20: Subtank
21: Filter
22: Replenishing agent supplying cum
23: Replenishing agent pusher claw
24: Replenishing agent
25: Cartridge

DETAILED DESCRIPTION OF THE PREFERRED EMBODIMENT

Although certain saccharides are known to be used as preservatives (Japanese Patent O.P.I. Publication No. 102727/1977), there has been no suggestion of the possibility that in preparing a solid processing agent capable of color development, saccharide addition ensures a solid processing agent of high moisture resistance and excellent solubility.

Also, the weight ratio, relative to the total solute content, of the color developing agent described in the above Japanese Patent O.P.I. Publication No. 102727/1977 is lower than 10%. The invention claimed in claim 6 of this specification is technically different from the invention of Japanese Patent O.P.I. Publication No. 102727/1977 in that it aims at rapider processing and waste liquid volume reduction by increasing the weight ratio of color developing agent in the solid photographic color developing composition above 10%.

The above-described saccharides are described in detail below.

Saccharides (also referred to as carbohydrates) are divided into two groups: monosaccharides and polysaccharides. Most of them are represented by the general formula $C_nH_{2n}O_n$. Monosaccharides generically refer to aldehydes or ketones of polyhydric alcohols, reduced derivatives, oxidized derivatives and dehydrated derivatives thereof, amino sugars, thio sugars and others. Polysaccharides refer to products resulting from dehydrated condensation of two or more of such monosaccharides.

Of these saccharides are preferred aldoses and derivatives thereof, with greater preference given to such aldoses and derivatives belonging to monosaccharides.

Examples of monosaccharides which can be used for the present invention are given below, which are not to be construed as limitative to the present invention.

(1)) Erythritol (2) β-D-arabinose
(3) β-L-arabinose
(4) D-xylose
(5) L-xylose
(6) 2-deoxy-β-D-ribose
(7) α-D- lyxose
(8) α-L-lyxose
(9) D-ribose
(10) L-ribose
(11) L-arabitol
(12) D-arabitol
(13) Ribitol
(14) β-D-altrose
(15) β-L-altrose
(16) β-D-allose
(17) β-L-allose
(18) β-D-galactose
(19) β-D-galactose
(20) α-L-galactose
(21) α-D-quinovose
(22) α-D-glucose
(23) β-D-glucose
(24) β-D-fructose
(25) Digitalose
(26) Digitoxose
(27) Cymarose
(28) L-sorbose
(29) D-tagatose
(30) α-D-talose
(31) 2-deoxy-D-glucose
(32) α-D-fucose
(33) α-L-fucose
(34) α-D-mannose
(35) L-mannose
(36) α-L-rhamnose
(37) D-inositol
(38) L-inositol
(39) Galactitol
(40) D-quercitol
(41) D-glucitol
(42) D-mannitol
(43) L-iduronic acid
(44) Galactaric acid
(45) α-D-galacturonic acid
(46) D-glucaric acid
(47) β-D-glucuronic acid
(48) D-gluconic acid
(49) L-gluconic acid
(50) 2-deoxy-D-gluconic acid
(51) D-mannuronic-6,3-lactone
(52) Methyl-β-D-galactopyranoside
(53) Methyl-α-D-gatactopyranoside
(54) Methyl-α-D-glucopyranoside
(55) Methyl-β-D-glucopyranos ide
(56) Methyl-α-D-fructofuranoside
(57) Methyl-α-D-mannopyranoside
(58) Methyl-β-D-mannopyranos ide
(59) N-acetyl-α-D-galactosamine
(60) N-acetyl-α-D-glucosamine
(61) N-acetyl-α-D-mannosamine
(62) Muramic acid
(63) α-D-galactosamine
(64) α-D-glucosamine
(65) D-mannosamine
(66) D-glycero-α-galacto-heptose
(67) D-glycero-β-L-manno-heptose
(68) D-manno-heptulose
(69) D-altro-3-heptulose
(70) D-glycero-D-galacto-heptitol
(71) D-glycero-D-talo-hept itol
(72) D-erythro-D-galacto-octitol Monosaccharides naturally occur widely, and commercial products are readily available. Various derivatives can easily be synthesized by reduction, oxidation, dehydration and other reactions.

"the solid photographic color developing composition contains all components necessary for a color development" of a silver halide color photographic light-sensitive material. Further, "the composition contains all component necessary for a color development" means that all replenishing chemicals used for a color developing tank are formed to the solid photographic color developing composition of the present invention. In the present invention, a replenishing liquid for a color developing tank can be composed of a replenishing water only at most. As a result, a handling for replenishing is simplified.

From the viewpoint of enhancement of the desired effect, the solid photographic color developing composition of the present invention preferably contains substantially no hydroxylamine or salt thereof, except for hydroxylamine derivatives having a substituent.

The color developing agent contained in the solid photographic color developing composition of the present invention is preferably a p-phenylenediamine color developing agent from the viewpoint of solubility and photographic performance. In this case, from the viewpoint of accomplishment of replenishing rate reduction and waste liquid volume reduction, which are among the desired effects of the invention, the weight ratio of the color developing agent to the total component content is not lower than 10%, more preferably not lower than 12%, and still more preferably not lower than 15%.

The above-described p-phenylenediamine color developing agent preferably has at least one hydrophilic group on their amino group or benzene ring because of advantages of freedom from light-sensitive material staining and of minimum skin irritation. Preferable hydrophilic groups include the following:

$$-(CH_2)_n-CH_2OH$$

$$-(CH_2)_m-NHSO_2-(CH_2)_n-CH_3$$

$$-(CH_2)_m-O-(CH_2)_n-CH_3$$

$$-(CH_2CH_2O)_nC_mH_{2m+1}$$

$$-(CH_2)_m-CON\begin{matrix}C_mH_{2m+1}\\C_mH_{2m+1}\end{matrix}$$

(m and n independently represent an integer of not less than 0)

$$-COOH$$

$$-SO_3H$$

Examples of color developing agents preferably used for the present invention include Example Compounds C-1 through C-16 described on pages 26 through 31 of Japanese Patent Application No. 203169/1990, Example Compounds 1 through 8 described on pages 29 through 31 of Japanese Patent O.P.I. Publication No. 289350/1986 and Example Compounds 1 through 26 described on pages 5 through 9 of Japanese Patent O.P.I. Publication No. 246543/1990, with preference given to Example Compounds C-1 and C-3 described in Japanese Patent Application No. 203169/1990, Example Compound 2 described in of Japanese Patent O.P.I. Publication No. 289350/1986 and Example Compound 1 described in of Japanese Patent O.P.I. Publication No. 246543/1990. These color developing agents are normally used in sulfate, hydrochloride, p-toluenesulfonate and other forms. Of these p-phenylenediamine color developing agents, 4-amino-3-methyl-N-ethyl-N(β-methanesulfonamidoethyl)aniline sesquisulfate monohydrate (CD-3) is so low in solubility in alkali solutions that waste liquid volume reduction and rapider processing by use of high concentrations of replenishers have been hampered. However, this problem can be solved by supplying the solid photographic color developing composition of the present invention directly to the replenisher, representing a preferred mode of embodiment of the invention.

When the solid photographic color developing composition of the present invention is dissolved to prepare a color developer solution, the p-phenylenediamine color developing agent content of the solution is preferably at least $1.5\times10^{-2}$ mol/l from the viewpoint of rapid processing.

The above-mentioned color developing agents, singly or in combination, may be used in combination with black-and-white developing agents such as phenidone, 4-hydroxymethyl-4-methyl-1-phenyl-3-pyrazolidone and Metol.

In addition to a developing agent, developing agent auxiliaries may be contained, including known compounds such as Metol, phenidone, N,N-diethyl-p-aminophenol hydrochloride and N,N,N',N'-tetramethyl-p-phenylenediamine hydrochloride.

In addition, various other additives such as antistaining agents, antisludging agents and developing accelerators may be added.

The solid photographic color developing composition relating to the present invention may incorporate a trace amount of sulfite as a preservative. Examples of such sulfites include sodium sulfite, potassium sulfite, sodium bisulfite and potassium bisulfite.

The solid photographic color developing composition relating to the present invention preferably contains a buffer. Examples of buffers include sodium carbonate, potassium carbonate, sodium bicarbonate, potassium bicarbonate, trisodium phosphate, tripotassium phosphate, trisodium phosphate, dipotassium phosphate, sodium borate, potassium borate, sodium tetraborate (boric acid), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

The solid photographic color developing composition relating to the present invention may incorporate developing accelerators as necessary. Examples of developing accelerators include thioether compounds such as those disclosed in Japanese Patent Examined Publication Nos. 16088/1962, 5987/1962, 7826/1963, 12380/1969 and 9019/1970 and U.S. Pat. No. 3,813,247, p-phenylenediamine compounds such as those disclosed in Japanese Patent O.P.I. Publication Nos. 49829/1977 and 15554/1975, quaternary ammonium salts such as those disclosed in Japanese Patent Examined Publication No. 30074/1969 and Japanese Patent O.P.I. Publication Nos. 137726/1975, 156826/1981 and 43429/1977, the p-aminophenols disclosed in U.S. Pat. Nos. 2,610,122 and 4,119,462, the amine compounds disclosed in U.S. Pat. Nos. 2,494,903, 3,128,182, 4,230,796, 3,253,919, 2,482,546, 2,596,926 and 3,582,346 and Japanese Patent Examined Publication No. 11431/1966, polyalkylene oxides such as those disclosed in Japanese Patent Examined Publication Nos. 16088/1962, 25201/1967, 11431/1966 and 23883/1966 and U.S. Pat. Nos. 3,128,183 and 3,532,501, and 1-phenyl-3-pyrrazolidones, hydrozines, meso-ionic compounds, ionic compounds and imidazoles.

In the present invention, chlorine ions, bromine ions and iodine ions may be added to the solid photographic color developing composition for preventing fogging and other purposes.

Also, the solid photographic color developing composition of the present invention may incorporate a triazinylstilbene brightening agent and the chelating agent represented by formula K described on line 9 from bottom, page 69, through page 95, of Japanese Patent Application No. 240400/1990. The solid photographic color developing composition may also contain an anionic surfactant, a cationic surfactant, an amphoteric surfactant and a nonionic surfactant.

The bleaching agents which are preferably used in the bleacher or bleach-fixer relating to the present invention are ferric complex salts of the organic acid represented by the following formula A.

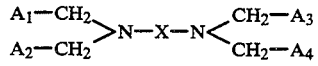

Formula A wherein $A_1$ through $A_4$, whether identical or not, independently represent —$CH_2OH$, —COOM or —$PO_3M_1M_2$ in which M, $M_1$ and $M_2$ independently represent a hydrogen atom, an atom of alkali metal or ammonium; X represents a substituted or unsubstituted alkylene group having 3 to 6 carbon atoms.

The compound represented by formula A is described in detail below.

$A_1$ through $A_4$ in formula IV are not described in detail here, since they have the same definitions as $A_1$ through $A_4$ described in line 15, page 12, through line 3, page 15, of Japanese Patent Application No. 260628/1989.

Examples of preferred compounds represented by the above formula A are given below.

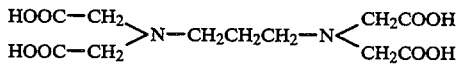

(A-1)

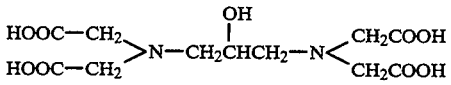

(A-2)

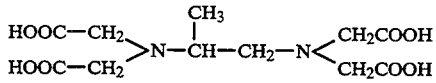

(A-3)

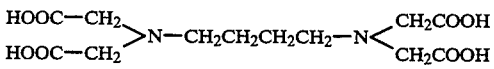

(A-4)

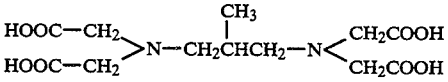

(A-5)

-continued

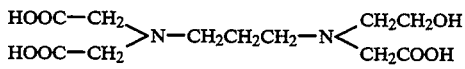
(A-6)

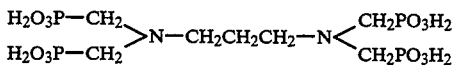
(A-7)

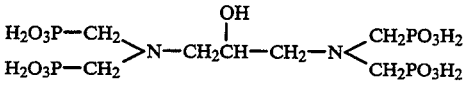
(A-8)

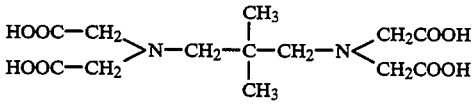
(A-9)

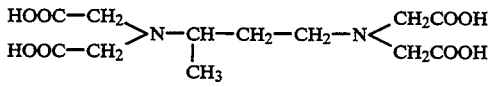
(A-10)

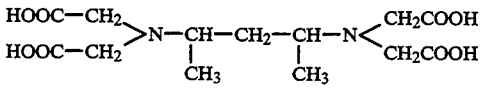
(A-11)

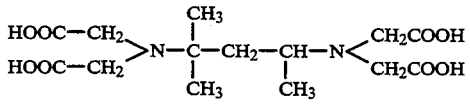
(A-12)

The ferric complex salts of these compounds A-1 through A-12 may be sodium salts, potassium salts or ammonium salts thereof, which can be selected optionally. From the viewpoint of the desired effect of the present invention and solubility, ammonium salts of these ferric complex salts are preferably used.

Of the compounds exemplified above, A-1, A-3, A-4, A-5 and A-9 are preferred, with more preference given to A-1.

In the present invention, ferric complex salts of the following compounds and others can be used as bleaching agents for the bleacher or bleach-fixer in addition to the iron complex salts of the compound represented by the above formula A.

A'-1: Ethylenediaminetetraacetic acid
A'-2: trans-1,2-cyclohexanediaminetetraacetic acid
A'-3: Dihydroxyethylglycinic acid
A'-4: Ethylenediaminetetrakismethylenephosphonic acid
A'-5: Nitrilotrismethylenephosphonic acid
A'-6: Diethylenetriaminepentakismethylenephosphonic acid
A'-7: Diethylenetriaminepentaacetic acid
A'-8: Ethylenediamine-di-o-hydroxyphenylacetic acid
A'-9: Hydroxyethylethylenediaminetriacetic acid
A'-10: Ethylenediaminedipropionic acid
A'-11: Ethylenediaminediacetic acid
A'-12: Hydroxyethyliminodiacetic acid
A'-13: Nitrilotriacetic acid
A'-14: Nitrilotripropionic acid
A'-15: Triethylenetetraminehexaacetic acid
A'-16: Ethylenediaminetetrapropionic acid The amount of the above-mentioned ferric complex salt of organic acid added is preferably in the range from 0.1 to 2.0 mol, more preferably from 0.15 to 1.5 mol per liter of bleacher or bleach-fixer.

The bleacher may incorporate at least one of the indazole described in Japanese Patent O.P.I. Publication No. 295258/1989, derivatives thereof and the compounds represented by formulas I through IX given in the same publication, whereby rapid processing is facilitated.

In addition to the above-mentioned developing accelerators, the example compounds given in pages 51 through 115 of Japanese Patent O.P.I. Publication No. 123459/1987, the example compounds given in pages 22 through 25 of Japanese Patent O.P.I. Publication No. 17445/1988 and the compounds described in Japanese Patent O.P.I. Publication Nos. 95630/1978 and 28426/1978 can also be used.

In addition to the above-mentioned additives, the bleacher or bleach-fixer may incorporate halides such as ammonium bromide, potassium bromide and sodium bromide, various brightening agents, defoaming agents and surfactants.

The fixing agents which are preferably used in the fixer or bleach-fixer for the present invention are thiocyanates and thiosulfates. The amount of thiocyanate added is preferably not less than 0.1 mol/l, more preferably not less than 0.5 mol/l, and still more preferably not less than 1.0 mol/l for processing a color negative film. The amount of thiosulfate added is preferably not less than 0.2 mol/l, more preferably not less than 0.5 mol/l for processing a color negative film. Also, the object of the present invention can be more efficiently accomplished by using a thiocyanate and a thiosulfate in combination.

In addition to these fixing agents, the fixer or bleach-fixer for the present invention may contain two or more pH regulators comprising various salts. It is also desirable to add a large amount of a re-halogenating agent such as an alkali halide or an ammonium halide, e.g., potassium bromide, sodium bromide, sodium chloride or ammonium bromide. Compounds which are known to be added to fixer or bleach-fixer, such as alkylamines and polyethylene oxides, may be added as appropriate.

It is preferable to add the compound described on page 56 of Japanese Patent O.P.I. Publication No. 295258/1989, represented by the following formula FA, to the fixer or bleach-fixer, whereby not only an additional effect is obtained in that sludge formation in the processing solution capable of fixing is significantly suppressed during prolonged processing of a small amount of light-sensitive material but also the effect of the invention is enhanced.

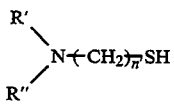
Formula FA

Compounds represented by formula FA can be synthesized by an ordinary method as described in U.S. Pat. Nos. 3335161 and 3260718. These compounds represented by formula FA may be used singly or in combination.

Good results are obtained when these compounds represented by formula FA are used in amounts of 0.1 to 200 g per liter of processing solution.

In the present invention, it is preferable to add a chelating agent having a ferric ion chelate stability constant of over 8 to the stabilizer. Here, the thelate stability constant is the constant which is well known in L. G. Sillen and A. E. Martell, "Stability Constants of Metal Ion Complexes", The Chemical Society, London (1964), S. Chaberek and A. E. Martell, "Organic Sequestering Agents", Wiley (1959), and other publications.

Examples of chelating agents having a ferric ion chelate stability constant of over 8 include those described in Japanese Patent Application Nos. 234776/1990 and 324507/1989.

The amount of the above chelating agent used is preferably 0.01 to 50 g, more preferably 0.05 to 20 g per liter of stabilizer, over which content range good results are obtained.

Ammonium compounds are preferably added to the stabilizer, which are supplied as ammonium salts of various inorganic compounds. The amount of ammonium compound added is preferably within the range from 0.001 to 1.0 mol, more preferably from 0.002 to 2.0 mol per liter of stabilizer. The stabilizer preferably contains a sulfite.

The stabilizer preferably contains a metal salt in combination with the chelating agent described above. Examples of such metal salts include salts of Ba, Ca, Ce, Co, In, La, Mn, Ni, Bi, Pb, Sn, Zn, Ti, Zr, Mg, Al and Sr, and it can be supplied as an inorganic salt such as halide, hydroxide, sulfate, carbonate, phosphate or acetate, or a water-soluble chelating agent. The amount of metal salt added is preferably within the range from $1\times10^{-4}$ to $1\times10^{-1}$ mol, more preferably from $4\times10^{-4}$ to $2\times10^{-2}$ mol per liter of stabilizer.

The stabilizer may contain an organic salt such as citrate, acetate, succinate, oxalate or benzoate, and a pH regulator such as malate, borate, hydrochloric acid or sulfate. In the present invention, one or more known fungicides can be used singly or in combination, as long as the use thereof does not adversely affect the effect of the invention.

Next, light-sensitive materials for applying the solid photographic color developing composition of the present invention are described below.

When the light-sensitive material is for picture taking use, silver iodobromide or silver iodochloride grains having an average silver iodide content of not lower than 3 mol% are used as silver halide grains, with preference given to silver iodobromide grains containing 4 to 15 mol% silver iodide. Particularly preferable average silver iodide contents for the present invention are 5 to 12 mol%, ideally 8 to 11 mol%.

In the light-sensitive material processed with the solid photographic color developing composition of the present invention, the silver halide emulsions described in Research disclosure No. 308119 (hereinafter referred to as RD308119) can be used. The following table shows where the additives are described.

| Item Pages in RD308119 | |
|---|---|
| Iodine structure | 993, I-Term A |
| Production method | 993, I-Term A and 994, Term E |
| Crystal habit: Normal crystal | 993, I-Term A |
| Twin crystal | 993, I-Term A |
| Epitaxial | 993, I-Term A |
| Halogen composition: Uniform | 993, I-Term B |
| Not uniform | 993, I-Term B |
| Halogen conversion | 994, I-Term C |
| Halogen substitution | 994, I-Term C |
| Metal content | 994, I-Term D |
| Monodispersion | 995, I-Term F |
| Solvent addition | 995, I-Term F |
| Site where latent images are formed: | |
| Surface | 995, I-Term G |
| Core | 995, I-Term G |

-continued

| Item Pages in RD308119 | |
|---|---|
| Applicable light-sensitive materials: | |
| Negative films | 995, I-Term H |
| Positive films (containing core fogging grains) | 995, I-Term H |
| Emulsion mixture | 995, I-Term J |
| Desalinization | 995, II-Term A |

In the present invention, the silver halide emulsion is used after physical ripening, chemical ripening and spectral sensitization. Additives used in these processes are described in Research Disclosure Nos. 17643, 18716 and 308119 (hereinafter referred to as RD17643, RD18716 and RD308119, respectively).

The following table shows where the additives are described.

| Item | Page in RD308119 | RD17643 | RD18716 |
|---|---|---|---|
| Chemical sensitizer | 996, III-Term A | 23 | 648 |
| Spectral sensitizer | 996, IV-Terms A-A, B, C, D, E, H, I, J | 23-24 | 648-649 |
| Supersensitizer | 996, IV-Terms A-E, J | 23-24 | 648-649 |
| Antifogging agent | 998, IV | 24-25 | 649 |
| Stabilizer | 998, VI | 24-25 | 649 |

Known photographic additives which can be used for the present invention are also described in the above Research Disclosure numbers. The following table shows where they are described.

| Item | Page in RD308119 | RD17643 | RD18716 |
|---|---|---|---|
| Antistaining agent | 1002, VII-Term I | 25 | 650 |
| Dye image stabilizer | 1001, VII-Term J | 25 | |
| Brightening agent | 998, V | 24 | |
| Ultraviolet absorbent | 1003, VIII-Term C, VIII-Term C | 25-26 | |
| Light absorbent | 1003, VIII | 25-26 | |
| Light scattering agent | 1003, VIII | | |
| Filter dye | 1003, VIII | 25-26 | |
| Binder | 1003, IX | 26 | 651 |
| Antistatic agent | 1006, VIII | 27 | 650 |
| Hardener | 1004, X | 26 | 651 |
| Plasticizer | 1006, XII | 27 | 650 |
| Lubricant | 1006, XII | 27 | 650 |
| Activator, coating aid | 1005, XI | 26-27 | 650 |
| Matting agent | 1007, X, VI | | |
| Developing agent (contained in the light-sensitive material) | 1011, XX-Term B | | |

The light-sensitive material processed with the solid photographic color developing composition of the present invention may incorporate various couplers. Examples thereof are described in the above Research Disclosure Numbers. The following table shows where they are described.

| Item | Page in RD308119 | RD17643 |
|---|---|---|
| Yellow coupler | 1001, VII-Term D | VII Terms C-G |
| Magenta coupler | 1001, VII-Term D | VII-Terms C-G |
| Cyan coupler | 1001, VII-Term D | VII-Terms C-G |
| DIR coupler | 1001, VII-Term F | VII-Term F |
| BAR coupler | 1002, VII-Term F | |
| Other couplers which release a useful residue | 1001, VII-Term F | |
| Alkali-soluble coupler | 1001, VII-Term E | |

The additives used for the present invention can be added by dispersion as described in RD308119 XIV and by other methods.

In the present invention, the supports described on page 28 of RD17643, pages 647 and 648 of RD18716, and RD308119 XIX can be used.

The light-sensitive material may be provided with auxiliary layers such as filter layers and interlayers as described in RD308119, VII-Term K. Also, the light-sensitive material can have various layer structures such as the ordinary layer structure, reverse layer structure and unit structure described in the above RD308119 VII-K.

Light-sensitive materials for printing preferred for application of the solid photographic color developing composition relating to the present invention are described below.

The silver halide grains in the light-sensitive material are silver halide grains based mainly on silver chloride wherein the silver chloride content is not lower than 80 mol%, more preferably not lower than 90 mol%, still more preferably not lower than 95 mol%, and most preferably not lower than 99 mol%.

In addition to silver chloride, the above-described silver halide emulsion based mainly on silver chloride may contain silver bromide and/or silver iodide in the silver halide composition. In this case, the silver bromide content is preferably not higher than 20 mol%, more preferably not higher than 10 mol%, and still more preferably not higher than 3 mol%, and when silver iodide is contained, the silver bromide content is preferably not higher than 1 mol%, more preferably not higher than 0.5 mol%, and most preferably zero. Such silver halide grains based mainly on silver chloride having a silver chloride content of over 80 mol% are added to at least one silver halide emulsion layer, but it is preferable to add them to all silver halide emulsion layers.

The silver halide grains may be of any crystal configuration, including normal and twin crystals, and any ratio of the [1.0.0] plane and the [1.1.1] plane is optionally usable. With respect to the crystal structure of these silver halide grains, it may be uniform from the inner to outer portions and may be of the core-shell type wherein the inner and outer portions are of different layer structures. These silver halides may be of any type, whether latent images are formed mainly on or in the grains. Moreover, tabular grains of silver halide such as those described in Japanese Patent O.P.I. Publication No. 113934/1983 and Japanese Patent Application No. 170070/1984 may be used. Also usable are the silver halide grains described in Japanese Patent O.P.I. Publication Nos. 26837/1989, 26838/1989 and 77047/1989.

The above-mentioned silver halide grains may be prepared by any of the acid method, the neutral method, the ammoniacal method and other methods.

It is also possible to use the method in which seed grains are formed by the acid method and grown to a given size by the ammoniacal method, which offers high speed grain growth. In growing silver halide grains, it is preferable to control the pH, pAg and other factors in the reactor and to sequentially or simultaneously add and mix silver ions and halide ions in an amount according to the rate of growth of silver halide grains as described in Japanese Patent O.P.I. Publication No. 48521/1979.

The red-sensitive silver halide emulsion layer of the light-sensitive material processed with the solid photographic color developing composition relating to the present invention may contain a non-diffusible color coupler which forms a cyan color image, usually a phenol or α-naphthol coupler. The green-sensitive layer may contain at least one non-diffusible color coupler which forms a magenta color image, usually a 5-pyrazolone color coupler or pyrrazolotriazole. The blue-sensitive layer may contain at least one non-diffusible color coupler which forms a yellow color image, usually a color coupler having an open chain ketomethylene group. The color coupler may be a 6-, 4- or 2-equivalent coupler, for instance.

A 2-equivalent coupler is particularly preferred for the color light-sensitive material for applying the solid photographic color developing composition of the present invention.

Appropriate couplers are disclosed in the following publications: W. Pelz, "Color Coupler" (Farbkuppler) in Mitteilunglnausden Forschungslaboratorien det Agfa, Leverkusen/Munchen, Vol. III, p. 111 (1961); K. Venkataraman, "The Chemistry of Synthetic Dyes", Vol. 4, pp. 341–387, Academic Press; "The Theory of the Photographic Processes", 4th edition, pp. 353–362; Research Disclosure No. 17643, Section VII.

In the light-sensitive material processed with the solid photographic color developing composition of the present invention, it is preferable to use the magenta coupler described on page 26 of Japanese Patent O.P.I. Publication No. 106655/1988, represented by formula M-1 (exemplified by magenta coupler Nos. 1 through 77 described in pages 29 through 34 of Japanese Patent O.P.I. Publication No. 106655/1988,), the cyan coupler described on page 34 of Japanese Patent O.P.I. Publication No. 106655/1988, represented by formula C-I or C-II (exemplified by cyan coupler Nos. C'-1 through C'-82 and C''-1 through C''-36 described on pages 37 through 42 of Japanese Patent O.P.I. Publication No. 106655/1988) and the rapid yellow coupler described on page 20 of Japanese Patent O.P.I. Publication No. 106655/1988 (exemplified by cyan coupler Nos. Y'-1 through Y'-39 described on pages 21 through 26 of Japanese Patent O.P.I. Publication No. 106655/1988).

In the present invention, it is preferable that in continuous processing of a silver halide color photographic light-sensitive material after imagewise exposure using an automatic processing machine, replenishment for the color developer bath be achieved by adding the solid photographic color developing composition of the present invention to a dissolution portion arranged in contact with the color developer and dissolving it.

An automatic processing machine preferably used for the present invention is configured with a processing tank for processing a silver halide color photographic light-sensitive material (main tank) and a dissolution portion for dissolving the solid processing agent (sub-tank) which communicate with each other and between which the respective solutions are circulated by a circulating means. The dissolution portion preferably has therein a filtering means preventing impurities in the supplied solid processing agent, insoluble matter or undissolved matter from entering the processing tank.

It is a preferred mode of embodiment of the present invention to supply water in an amount such that at least the water loss due to evaporation is compensated, while adding the solid processing agent to the dissolution portion. In other words, any processing tank at a given temperature constantly undergoes evaporation, leading to liquid level reduction and liquid concentration unless water is supplied, which can cause photographic performance deterioration, precipitation, tar formation and other problematic phenomena. It is therefore necessary to supply sufficient water to keep a given tank liquid level.

In supplying water for this purpose, water carried away by the light-sensitive material must be considered in addition to water loss due to evaporation, particularly for the color developer tank. It should be noted, however, that excess water supply is undesirable for the effect of the invention and also poses problems such as increased waste liquid volume. It is therefore a preferred mode of embodiment of the present invention to set the water supply rate so that the amount of overflow will be not higher than 5%, preferably not higher than 3% of the processing tank capacity.

The automatic processing machine preferably has a detector for sensing the amount of silver halide color photographic light-sensitive material processed, an automatic solid processing agent supplier for automatically supplying the solid processing agent to the dissolution portion according to the amount of processing and a water supplier for the above-described water supply.

In the present invention, conventional manual dissolution operation can be substantially obviated by using an automatic processing machine having a processing portion for processing a light-sensitive material and a dissolution portion for dissolving a solid photographic processing agent, which dissolution portion is arranged in contact with the processing solution in the processing portion and is equipped with a dissolver. In addition, it is even possible to obviate replenisher tanks and replenisher supplying pumps, which occupy about half the inner space of an automatic processing machine, leading to significant cost reduction and equipment or instrumental size reduction. Moreover, processing agent dissolution is facilitated by the dissolver equipped in the dissolution portion even for solid photographic processing agents, preventing local concentration and allowing uniform concentration distribution over the entire processing portion.

In the absence of a dissolution portion, when tablets or granules are added directly to a tank solution tank or replenisher tank, for instance, local photographic processing agent concentration occurs due to sedimentation of alkali agents etc. on the tank bottom because of the low dissolving speed, though initial solubility is slightly good, which in turn results in tar or insoluble matter formation, thus having a significant adverse effect on photographic performance and circulatory system clogging etc.

The photographic processing agent of the present invention, in a solid form, is free from scattering of part agents during operation to cause contamination of the human body, especially hands and clothing, and instruments, and is environmentally desirable in that no plastic bottles are necessary.

Moreover, the processing agent supplier attached to the dissolution portion of the automatic processing machine obviates the need of manual addition of processing agents to the dissolution portion, offering significant improvement in operational efficiency.

EXAMPLES

Example 1

Photographic processing tablets for color negative films were prepared as follows:

Color developer replenishing tablets for color negative films

PROCEDURE (1)

65 g of the developing agent CD-4 [4-amino-3-methyl-N-ethyl-$\beta$-(hydroxy)ethylaniline sulfate] was milled in an air jet mill to a final average grain size of 10 $\mu$m. The fine powder thus obtained was granulated in a commercially available fluidized bed spray granulator at room temperature for about 8 minutes, while adding 5.0 ml of water. The granulation product was dried at 60° C. for 10 minutes and then dried in a vacuum at 40° C. for 2 hours to remove almost all the water therefrom.

Procedure (2)

0.46 mol of each of the preservatives listed in Table 1 (monosaccharides, shown by Example Compound Number, or comparative compounds) was milled and granulated in the same manner as procedure (1). The amount of water added was 2.6 ml. The granulation product was dried at 60° C. for 7 minutes and then dried in a vacuum at 40° C. for 2 hours to remove almost all the water therefrom.

Procedure (3)

58 g of sodium sulfite, 380 g of potassium carbonate, 3 g of sodium hydrogen carbonate, 4 g of sodium bromide and 25 g of diethylenetriaminetetraacetic acid were milled in the same manner as procedure (1) and then uniformly mixed in a commercially available mixer, after which they were granulated, while adding 200 ml of water. The granulation product was then dried at 65° C. for 15 minutes and then dried in a vacuum at 40° C. for 2 hours to remove almost all the water therefrom.

Procedure (4)

The granulation products obtained in the above procedures (1) through (3) were uniformly mixed in a mixer for about 10 minutes in a room kept at 25° C. and under 40% RH for moisture conditioning. The resulting mixture was subjected to compressive tableting using a tableting machine, a modification of Tough Press Correct 1527HU, produced by Kikusui Seisakusho, to yield 100 color developer replenishing tablets for color negative films.

Five tablet samples of each tablet agent thus obtained were tightly packed in a polyethylene bag and stored at 70° C. and 80% RH for 1 month. After storage, the tablet samples were evaluated as to appearance by macroscopic observation. Also evaluated was the solubility of four tablets of each agent in 500 ml of water. The amount of color developing agent after storage was determined to calculate the residual rate relative to the sample before storage.

Tablet appearance after storage was evaluated by the following criteria:

A: Almost no tablet deformation or color change

B: Slight blackening seen but almost no tablet deformation

C: Slight blackening seen and slight tablet deformation

D: Blackening seen and tablet deformation due to deliquescence

Solubility was evaluated by the following criteria:

A: Immediately completely dissolved without stirring

B: Gradually dissolved, reaching complete dissolution in 1 hour without stirring C: Gradually dissolved, with residual solid, which was eventually dissolved by stirring D: Gradually dissolved, with residual solid, which remained undissolved even after stirring The results are given in Tables 1 and 2.

TABLE 1

| Experiment No. | Preservative | CD-4 residual rate (%) | Appearance | Solubility |
|---|---|---|---|---|
| 1-1 (comparative) | None | 60 | D | D |
| 1-2 (comparative) | Hydroxylamine sulfate | 73 | D | C |
| 1-3 (comparative) | Lactose | 66 | D | C |
| 1-4 (inventive) | (2) | 87 | B | B |
| 1-5 (inventive) | (4) | 89 | B | A |
| 1-6 (inventive) | (6) | 94 | B | A |
| 1-7 (inventive) | (9) | 96 | B | A |
| 1-8 (inventive) | (10) | 95 | B | A |
| 1-9 (inventive) | (16) | 93 | B | A |
| 1-10 (inventive) | (17) | 95 | B | A |
| 1-11 (inventive) | (18) | 87 | B | B |
| 1-12 (inventive) | (19) | 88 | B | B |
| 1-13 (inventive) | (20) | 87 | B | B |
| 1-14 (inventive) | (22) | 86 | B | B |
| 1-15 (inventive) | (23) | 89 | B | B |
| 1-16 (inventive) | (26) | 92 | B | A |
| 1-17 (inventive) | (27) | 95 | B | A |
| 1-18 (inventive) | (30) | 86 | C | B |

TABLE 2

| Experiment No. | Preservative | CD-4 residual rate (%) | Appearance | Solubility |
|---|---|---|---|---|
| 1-19 (inventive) | (31) | 88 | B | B |
| 1-20 (inventive) | (32) | 87 | C | B |
| 1-21 (inventive) | (34) | 88 | B | B |
| 1-22 (inventive) | (36) | 89 | B | A |
| 1-23 (inventive) | (43) | 87 | B | B |
| 1-24 (inventive) | (44) | 86 | C | B |
| 1-25 (inventive) | (48) | 86 | B | B |
| 1-26 (inventive) | (49) | 88 | B | B |
| 1-27 (inventive) | (52) | 83 | C | B |
| 1-28 (inventive) | (59) | 90 | B | B |
| 1-29 (inventive) | (60) | 91 | B | A |
| 1-30 (inventive) | (61) | 90 | B | B |
| 1-31 (inventive) | (63) | 90 | B | B |
| 1-32 (inventive) | (64) | 92 | B | A |
| 1-33 (inventive) | (65) | 89 | B | B |
| 1-34 (inventive) | (66) | 86 | C | B |
| 1-35 (inventive) | (69) | 84 | C | B |

From Tables 1 and 2, it is seen that the solid photographic color developing compositions incorporating the preservative of the present invention have good storage stability and excellent solubility.

Example 2

Photographic processing agents for color printing paper were prepared as follows:

PROCEDURE (A)

100 g of developing agent CD-3 [4-amino-3-methyl-N-ethyl-N-[β-(methanesulfonamido)ethyl]aniline sulfate] was milled in an air jet mill to a final average grain size of 10 μm. The fine powder thus obtained was granulated in a commercially available fluidized bed spray granulator at room temperature for about 5 minutes, while adding 4.0 ml of water. The granulation product was dried at 60° C. for 10 minutes and then dried in a vacuum at 40° C. for 2 hours to remove almost all the water therefrom.

Procedure (B)

0.41 mol of each of the compounds listed in Tables 3 and 4 was milled and granulated in the same manner as procedure (A). The amount of water added was 3.0 ml. The granulation product was dried at 60° C. for 10 minutes and then dried in a vacuum at 40° C. for 2 hours to remove almost all the water therefrom.

Procedure (C)

30 g of Tinopal SFP (produced by Ciba-Geigy), 2.0 g of sodium sulfite, 400 g of potassium carbonate, 0.5 g of potassium bromide, 30 g of diethylenetriaminepentaacetic acid, 200 g of polyethylene glycol (average molecular weight 6000) and 15 g of potassium hydroxide were milled in the same manner as procedure (A) and then uniformly mixed in a commercially available mixer. Then, the mixture was granulated in the same manner as procedure (A), while adding 200 ml of water. The granulation product was dried at 65° C. for 15 minutes and then dried in a vacuum at 40° C. for 2 hours to remove almost all the water therefrom.

Procedure (D)

The granulation products prepared in the above procedures (A) through (C) were uniformly mixed for 10 minutes using a mixer in a room kept at 25° C. and under 40% RH for moisture conditioning. The resulting mixture was subjected to compressive tableting, using a tableting machine, a modification of Tough Press Correct 1527HU, produced by Kikusui Seisakusho, to yield 100 color developer replenishing tablets for color for color printing paper.

Five tablet samples of each tablet agent thus obtained were tightly packed in a polyethylene bag and stored at 70° C. and 80% RH for 1 month. After storage, the tablet samples were evaluated with the same criteria and in the same manner as in Example 1. The results are given in Tables 3 and 4.

TABLE 3

| Experiment No. | Preservative | CD-3 residual rate (%) | Appearance | Solubility |
|---|---|---|---|---|
| 2-1 (comparative) | None | 58 | D | D |
| 2-2 (comparative) | Hydroxylamine sulfate | 75 | D | C |
| 2-3 (comparative) | Lactose | 68 | D | D |
| 2-4 (inventive) | (2) | 85 | B | B |
| 2-5 (inventive) | (4) | 86 | B | B |
| 2-6 (inventive) | (6) | 92 | B | A |
| 2-7 (inventive) | (9) | 94 | B | A |
| 2-8 (inventive) | (10) | 94 | B | A |
| 2-9 (inventive) | (16) | 90 | B | A |
| 2-10 (inventive) | (17) | 93 | B | A |
| 2-11 (inventive) | (18) | 86 | B | B |
| 2-12 (inventive) | (19) | 86 | B | B |
| 2-13 (inventive) | (20) | 87 | B | B |
| 2-14 (inventive) | (22) | 88 | B | B |
| 2-15 (inventive) | (23) | 85 | B | B |
| 2-16 (inventive) | (26) | 90 | B | A |
| 2-17 (inventive) | (27) | 93 | B | A |
| 2-18 (inventive) | (31) | 85 | C | B |

TABLE 4

| Experiment No. | Preservative | CD-3 residual rate (%) | Appearance | Solubility |
|---|---|---|---|---|
| 2-19 (inventive) | (34) | 86 | B | B |
| 2-20 (inventive) | (36) | 87 | B | A |
| 2-21 (inventive) | (43) | 85 | B | B |
| 2-22 (inventive) | (44) | 83 | C | B |
| 2-23 (inventive) | (48) | 85 | B | B |
| 2-24 (inventive) | (49) | 84 | C | B |
| 2-25 (inventive) | (59) | 89 | B | B |
| 2-26 (inventive) | (60) | 90 | B | A |
| 2-27 (inventive) | (61) | 88 | B | B |
| 2-28 (inventive) | (63) | 90 | B | B |
| 2-29 (inventive) | (64) | 91 | B | A |
| 2-30 (inventive) | (65) | 88 | B | B |
| 2-31 (inventive) | (69) | 82 | C | B |

From Tables 3 and 4, it is seen that the solid photographic color developing compositions incorporating the preservative of the present invention have good storage stability and excellent solubility.

Example 3

Tableting was conducted in the same manner as in Example 1 at various weight ratios of the developing agent CD-4 in tablets as shown in Tables 5 and 6, to yield 100 color developing tablets for color negative films. Five tablet samples of each tablet agent thus obtained were tightly packed in a polyethylene bag and stored at 65° C. and 70% RH for 4 weeks. After storage, the tablet samples were evaluated with the same criteria and in the same manner as in Example 1. The results are given in Tables 5 and 6.

TABLE 5

| Experiment No. | Preservative | CD-4 weight ratio (%) | CD-4 residual rate (%) | Appearance | Solubility |
|---|---|---|---|---|---|
| 3-1 (comparative) | Hydroxylamine sulfate | 8 | 78 | D | B |
| 3-2 (comparative) | Hydroxylamine sulfate | 10 | 75 | D | C |
| 3-3 (comparative) | Hydroxylamine sulfate | 12 | 73 | D | C |
| 3-4 (comparative) | Hydroxylamine sulfate | 15 | 69 | D | C |
| 3-5 (comparative) | Hydroxylamine sulfate | 18 | 66 | D | D |
| 3-6 (comparative) | Lactose | 8 | 72 | D | B |
| 3-7 (comparative) | Lactose | 10 | 69 | D | C |
| 3-8 (comparative) | Lactose | 12 | 67 | D | C |
| 3-9 (comparative) | Lactose | 15 | 64 | D | C |
| 3-10 (comparative) | Lactose | 18 | 61 | D | D |
| 3-11 (inventive) | (9) | 8 | 98 | B | A |
| 3-12 (inventive) | (9) | 10 | 97 | B | A |
| 3-13 (inventive) | (9) | 12 | 97 | B | A |
| 3-14 (inventive) | (9) | 15 | 95 | B | A |

TABLE 5-continued

| Experiment No. | Preservative | CD-4 weight ratio (%) | CD-4 residual rate (%) | Appearance | Solubility |
|---|---|---|---|---|---|
| 3-15 (inventive) | (9) | 18 | 93 | B | B |

TABLE 6

| Experiment No. | Preservative | CD-4 weight ratio (%) | CD-4 residual rate (%) | Appearance | Solubility |
|---|---|---|---|---|---|
| 3-16 (inventive) | (16) | 8 | 95 | B | A |
| 3-17 (inventive) | (16) | 10 | 94 | B | A |
| 3-18 (inventive) | (16) | 12 | 94 | B | A |
| 3-19 (inventive) | (16) | 15 | 92 | B | B |
| 3-20 (inventive) | (16) | 18 | 90 | B | B |
| 3-21 (inventive) | (27) | 8 | 96 | B | A |
| 3-22 (inventive) | (27) | 10 | 95 | B | A |
| 3-23 (inventive) | (27) | 12 | 95 | B | A |
| 3-24 (inventive) | (27) | 15 | 93 | B | B |
| 3-25 (inventive) | (27) | 18 | 91 | B | B |
| 3-26 (inventive) | (64) | 8 | 95 | B | A |
| 3-27 (inventive) | (64) | 10 | 95 | B | A |
| 3-28 (inventive) | (64) | 12 | 95 | B | A |
| 3-29 (inventive) | (64) | 15 | 94 | B | A |
| 3-30 (inventive) | (64) | 18 | 92 | B | B |

From Tables 5 and 6, it is seen that as the color developing agent content increases, the tablet samples according to the present invention retain good storage stability and solubility, while the comparative samples undergo deterioration in storage stability and solubility.

Example 4

Tableting was conducted in the same manner as in Example 1 at various weight ratios of the developing agent CD-3 in tablets as shown in Tables 7 and 8, to yield 100 color developing tablets for color negative films. Five tablet samples of each tablet agent thus obtained were tightly packed in a polyethylene bag and stored at 65° C. and 70% RH for 4 weeks. After storage, the tablet samples were evaluated with the same criteria and in the same manner as in Example 1. The results are given in Tables 7 and 8.

TABLE 7

| Experiment No. | Preservative | CD-3 weight ratio (%) | CD-3 residual rate (%) | Appearance | Solubility |
|---|---|---|---|---|---|
| 4-1 (comparative) | Hydroxylamine sulfate | 8 | 77 | D | C |
| 4-2 (comparative) | Hydroxylamine sulfate | 10 | 76 | D | C |
| 4-3 (comparative) | Hydroxylamine sulfate | 12 | 74 | D | D |
| 4-4 (comparative) | Hydroxylamine sulfate | 15 | 70 | D | D |
| 4-5 (comparative) | Hydroxylamine sulfate | 18 | 68 | D | D |
| 4-6 (comparative) | Lactose | 8 | 74 | D | C |
| 4-7 (comparative) | Lactose | 10 | 72 | D | D |
| 4-8 (comparative) | Lactose | 12 | 70 | D | D |
| 4-9 (comparative) | Lactose | 15 | 66 | D | D |
| 4-10 (comparative) | Lactose | 18 | 63 | D | D |
| 4-11 (inventive) | (9) | 8 | 96 | B | A |
| 4-12 (inventive) | (9) | 10 | 95 | B | A |
| 4-13 (inventive) | (9) | 12 | 95 | B | A |
| 4-14 (inventive) | (9) | 15 | 94 | B | A |
| 4-15 (inventive) | (9) | 18 | 92 | B | B |

TABLE 8

| Experiment No. | Preservative | CD-3 weight ratio (%) | CD-3 residual rate (%) | Appearance | Solubility |
|---|---|---|---|---|---|
| 4-16 (inventive) | (16) | 8 | 94 | B | A |
| 4-17 (inventive) | (16) | 10 | 93 | B | A |
| 4-18 (inventive) | (16) | 12 | 92 | B | A |
| 4-19 (inventive) | (16) | 15 | 90 | B | B |
| 4-20 (inventive) | (16) | 18 | 89 | C | B |
| 4-21 (inventive) | (27) | 8 | 95 | B | A |
| 4-22 (inventive) | (27) | 10 | 94 | B | A |
| 4-23 (inventive) | (27) | 12 | 93 | B | A |
| 4-24 (inventive) | (27) | 15 | 91 | B | B |
| 4-25 (inventive) | (27) | 18 | 90 | C | B |
| 4-26 (inventive) | (64) | 8 | 94 | B | A |
| 4-27 (inventive) | (64) | 10 | 93 | B | A |
| 4-28 (inventive) | (64) | 12 | 92 | B | A |
| 4-29 (inventive) | (64) | 15 | 90 | B | B |

TABLE 8-continued

| Experiment No. | Preservative | CD-3 weight ratio (%) | CD-3 residual rate (%) | Appearance | Solubility |
|---|---|---|---|---|---|
| 4-30 (inventive) | (64) | 18 | 89 | B | B |

From Tables 7 and 8, it is seen that as the color developing agent content increases, the tablet samples according to the present invention retain good storage stability and solubility, while the comparative samples undergo deterioration in storage stability and solubility.

Example 5

The following four color developer replenishing agents for color negative films were prepared.

Color Developer Replenishing Agent (i)

| | |
|---|---|
| Preservative listed in Table 9 | 0.05 mol |
| 4-amino-3-methyl-N-ethyl-N-(β-hydroxyethyl)aniline sulfate CD-4 | 6.5 g |
| Sodium sulfite | 6 g |
| This composition is referred to as part A. | |
| Potassium carbonate | 38 g |
| Sodium hydrogen carbonate | 0.3 g |
| Sodium bromide | 0.4 g |
| Diethylenetriaminepentaacetic acid | 2.5 g |

This composition is referred to as part B.

Each part was dissolved in water and filled up to 500 ml (shown as "2-part agent" in Table 9). Separately, all components were dissolved in water and filled up to 1 l (shown as "1-part agent" in Table 9).

Color Developer Replenishing Agent (ii)

| | |
|---|---|
| Preservative listed in Table 9 | 0.025 mol |
| 4-amino-3-methyl-N-ethyl-N-(β-hydroxyethyl)aniline sulfate CD-4 | 3.3 g |
| Sodium sulfite | 3 g |
| This composition is referred to as part A. | |
| Potassium carbonate | 19 g |
| Sodium hydrogen carbonate | 0.15 g |
| Sodium bromide | 0.2 g |
| Diethylenetriaminepentaacetic acid | 2.5 g |

This composition is referred to as part B.

Each part, in the form of powder as such, was packed in a polyethylene bag (shown as "2-part agent" in Table 9). Separately, all components, in the form of powder as such, were packed in a polyethylene bag (shown as "1-part agent" in Table 9).

Color Developer Replenishing Agent (iii)

The same components as of the above-described color developer replenishing agent (ii), separately in parts A and B, were granulated, and each part of granules were packed in a polyethylene bag (shown as "2-part agent" in Table 9). Separately, all components were uniformly mixed and granulated, and all granules were packed in a polyethylene bag (shown as "1-part agent" in Table 9).

Color Developer Replenishing Agent (iv)

The same components as of the above-described color developer replenishing agent (ii), separately in parts A and B, were tableted, and five tablets of each part were packed in a polyethylene bag (shown as "2-part agent" in Table 9). Separately, all components were uniformly mixed and tableted, and all five tablets were packed in a polyethylene bag (shown as "1-part agent" in Table 9).

These color developer replenishing agents were stored at 65° C. and 70% RH for 4 weeks. After storage, each sample was evaluated in the same manner as in Example 1. The results are given in Table 9.

In Table 9, the symbols for appearance rating have the following meanings:

A: No change
B: Slight browning
C: Considerable blackening
D: Black tarry substance seen Solubility was evaluated with the same criteria as in Example 1.

TABLE 9

| Experiment No. | Preservative | Color developer replenishing agent | | CD-4 residual rate (%) | Appearance | Solubility |
|---|---|---|---|---|---|---|
| 5-1 (comparative) | Lactose | (i) | 2-part agent | 63 | Yellowish brown | — |
| 5-2 (comparative) | | | 1-part agent | 51 | Much tar | — |
| 5-3 (comparative) | | (ii) | 2-part agent | 67 | C | C |
| 5-4 (comparative) | | | 1-part agent | 61 | D | D |
| 5-5 (comparative) | | (iii) | 2-part agent | 68 | C | C |
| 5-6 (comparative) | | | 1-part agent | 63 | D | D |
| 5-7 (comparative) | | (iv) | 2-part agent | 70 | C | C |
| 5-8 (comparative) | | | 1-part agent | 67 | D | D |
| 5-9 (inventive) | (9) | (i) | 2-part agent | 93 | Yellowish brown | — |
| 5-10 (inventive) | | | 1-part agent | 76 | Slight tar formation | — |
| 5-11 (inventive) | | (ii) | 2-part agent | 94 | B | A |
| 5-12 (inventive) | | | 1-part agent | 85 | C | B |
| 5-13 (inventive) | | (iii) | 2-part agent | 96 | B | A |
| 5-14 (inventive) | | | 1-part agent | 88 | C | B |
| 5-15 (inventive) | | (iv) | 2-part agent | 96 | B | A |
| 5-16 (inventive) | | | 1-part agent | 95 | B | A |

From Table 9, it is seen that when the preservative of the present invention is incorporated, the color developer replenishing agent, in the form of tablets, granules or powder, has significantly improved storage stability and solubility, and that in the case of tablet form, in particular, excellent storage stability and solubility can be retained even with a 1-part agent.

Example 6

The following four color developer replenishing agents for color printing paper were prepared.

Color Developer Replenishing Agent (i')

| | |
|---|---|
| Preservative listed in Table 10 | 0.04 mol |
| 4-amino-3-methyl-N-ethyl-N-(β-methanesulfonamidoethyl) aniline sesquisulfate CD- | 10 g |
| Sodium sulfite | 0.2 g |
| Tinopal SFP (produced by Ciba-Geigy) | 3 g |
| This composition is referred to as part A. | |
| Potassium carbonate | 40 g |
| Diethylenetriaminepentaacetic acid | 3 g |
| Sodium bromide | 0.05 g |
| Polyethylene glycol (average molecular weight 6000) | 20 g |

This composition is referred to as part B.

Each part was dissolved in water and filled up to 500 ml (shown as "2-part agent" in Table 10). Separately, all components were dissolved in water and filled up to 1 l (shown as "1-part agent" in Table 10).

Color Developer Replenishing Agent (ii')

| | |
|---|---|
| Preservative listed in Table 10 | 0.02 mol |
| 4-amino-3-methyl-N-ethyl-N-(β-methanesulfonamidoethyl) aniline sesquisulfate CD-3 | 5 g |
| Sodium sulfite | 0.1 g |
| Tinopal SFP (produced by Ciba-Geigy) | 1.5 g |
| This composition is referred to as part A. | |
| Potassium carbonate | 20 g |
| Diethylenetriaminepentaacetic acid | 1.5 g |
| Potassium bromide | 0.025 g |
| Polyethylene glycol (average molecular weight 6000) | 10 g |

This composition is referred to as part B.

Each part, in the form of powder as such, was packed in a polyethylene bag (shown as "2-part agent" in Table 10). Separately, all components, in the form of powder as such, were packed in a polyethylene bag (shown as "1-part agent" in Table 10).

Color Developer Replenishing Agent (iii')

The same components as of the above-described color developer replenishing agent (ii'), separately in parts A and B, were granulated, and each part of granules were packed in a polyethylene bag (shown as "2-part agent" in Table 10). Separately, all components were uniformly mixed and granulated, and all granules were packed in a polyethylene bag (shown as "1-part agent" in Table 10).

Color Developer Replenishing Agent (iv')

The same components as of the above-described color developer replenishing agent (ii'), separately in parts A and B, were tableted, and five tablets of each part were packed in a polyethylene bag (shown as "2-part agent" in Table 10). Separately, all components were uniformly mixed and tableted, and all five tablets were packed in a polyethylene bag (shown as "1-part agent" in Table 10).

These color developer replenishing agents were stored at 65° C. and 70% RH for 4 weeks. After storage, each sample was evaluated in the same manner as in Example 1. The results are given in Table 10.

In Table 10, the evaluation criteria for appearance and solubility are the same as in Example 5.

TABLE 10

| Experiment No. | Preservative | Color developer replenishing agent | | CD-4 residual rate (%) | Appearance | Solubility |
|---|---|---|---|---|---|---|
| 6-1 (comparative) | Lactose | (i') | 2-part agent | 61 | Yellowish brown | — |
| 6-2 (comparative) | | | 1-part agent | 48 | Much tar | — |
| 6-3 (comparative) | | (ii') | 2-part agent | 67 | C | C |
| 6-4 (comparative) | | | 1-part agent | 62 | D | D |
| 6-5 (comparative) | | (iii') | 2-part agent | 69 | C | C |
| 6-6 (comparative) | | | 1-part agent | 64 | D | D |
| 6-7 (comparative) | | (iv') | 2-part agent | 72 | C | C |
| 6-8 (comparative) | | | 1-part agent | 68 | D | D |
| 6-9 (inventive) | (9) | (i') | 2-part agent | 90 | Yellowish brown | — |
| 6-10 (inventive) | | | 1-part agent | 73 | Slight tar formation | — |
| 6-11 (inventive) | | (ii') | 2-part agent | 94 | B | A |
| 6-12 (inventive) | | | 1-part agent | 83 | C | B |
| 6-13 (inventive) | | (iii') | 2-part agent | 95 | B | A |
| 6-14 (inventive) | | | 1-part agent | 87 | C | B |
| 6-15 (inventive) | | (iv') | 2-part agent | 95 | B | A |
| 6-16 (inventive) | | | 1-part agent | 94 | B | A |

From Table 10, it is seen that when the preservative of the present invention is incorporated, the color developer replenishing agent, in the form of tablets, granules or powder, has significantly improved storage stability and solubility, and that in the case of tablet form, in particular, excellent storage stability and solubility can be retained even with a 1-part agent.

Example 7

A color developer replenisher was prepared with the following composition:

| | |
|---|---|
| Example Compound 9 | 5.9 g |
| Developing agent listed in Table 11 | See Table 11 |
| Sodium sulfite | 0.2 g |
| Potassium carbonate | 40 g |
| Tinopal SFP (Ciba-Geigy) | 3.0 g |
| Diethylenetriaminepentaacetic acid | 3.0 g |
| Potassium bromide | 0.05 g |
| Polyethylene glycol (average molecular weight 6000) | 20 g |

-continued

| | |
|---|---|
| Potassium hydroxide | 1 g |

These components were dissolved in water and filled up to 1 l. The resulting solution was adjusted to pH 10.6 with sulfuric acid or an aqueous potassium hydroxide solution.

Separately, the same composition as above was tableted in the same manner as in Example 2 to yield 10 color developer replenishing tablets.

Each color developer replenisher was stored in a 1-liter beaker, left open, at room temperature. Five tablet samples of each agent were kept standing at room temperature. One week later, the color developer replenisher was observed as to appearance. The residual rates of developing agent were determined. For the replenishers showing precipitation, the supernatant was collected and determined for developing agent concentration.

Replenishers were evaluated as to appearance with the following criteria:

A: No precipitate seen with only slight coloring
B: No precipitate seen but considerable coloring
C: Crystalline precipitate seen The results are given in Table 11.

TABLE 11

| Sample No. | Form | Color developing agent (*1) | Amount of addition (mol) | Replenisher appearance | Developing agent residual rate (%) | Remark |
|---|---|---|---|---|---|---|
| 7-1 | Solution | CD-3 (C-1) | 0.02 | B | 88 | Comparative |
| 7-2 | Solution | CD-3 (C-1) | 0.03 | C | 70 | Comparative |
| 7-3 | Solution | CD-4 (C-3) | 0.02 | A | 89 | Comparative |
| 7-4 | Solution | CD-4 (C-3) | 0.03 | B | 87 | Comparative |
| 7-5 | Solution | CD-6 (C-4) | 0.02 | A | 91 | Comparative |
| 7-6 | Solution | CD-6 (C-4) | 0.03 | A | 90 | Comparative |
| 7-7 | Tablet | CD-3 (C-1) | 0.02 | — | 99 | Inventive |
| 7-8 | Tablet | CD-3 (C-1) | 0.03 | — | 98 | Inventive |
| 7-9 | Tablet | CD-4 (C-3) | 0.02 | — | 99 | Inventive |
| 7-10 | Tablet | CD-4 (C-3) | 0.03 | — | 98 | Inventive |
| 7-11 | Tablet | CD-6 (C-4) | 0.02 | — | 98 | Inventive |
| 7-12 | Tablet | CD-6 (C-4) | 0.03 | — | 99 | Inventive |

*Example Compounds described on pages 26 and 27 of Japanese Patent Application No. 203169/1990.

From Table 11, it is seen that when 4-amino-3-methyl-N-ethyl-N-(β-methanesulfonamidoethyl)aniline sesquisulfate monohydrate (CD-3) is used at high concentrations, the conventional solution replenishing method fails to retain a constant developing agent concentration due to precipitation. When CD-3 is used as a developing agent, a high replenishing rate is required, resulting in a large amount of waste liquid. By adding the solid processing agent of the present invention directly to the solution, diluent water required for conventional replenishing can be significantly saved. This effect surpasses that obtained when CD-3, which is less soluble in water, is used as a color developing agent.

Example 8

After exposure by a conventional method, samples as described in Japanese Patent Application No. 234777/1990 were subjected to a running processing test using the following automatic processing machine and processing agents.

Automatic processing machine

Using Konica color negative film processor CL-KP-50QA, modified to have tablet supplying, liquid level sensing and warm water supplying functions, processing experiments were conducted.

FIG. 1 is a schematic diagram of an example of the automatic processing machine relating to the present invention, showing an outline of the controlling mechanism of a color negative film processing machine.

Upon detection of a given area of color negative film introduced via light-sensitive material inlet 13 and passing light-sensitive area detection sensor 7, replenishing agent supplier 8, replenishing water supplier 10 and electromagnetic valve 12 are activated in response to a signal from controller 11 to supply appropriate amounts of the replenishing agent and replenishing water for solution preparation to respective processing baths 1, 2, 3 and 5.

When the automatic processing machine is temperature conditioned for several hours, processing solution 17 in each of processing baths 1 through 5 evaporates. Upon reach of a given lower limit of liquid level, liquid level sensor 9 is activated to drive replenishing water supplier 10 and electromagnetic valve 12 upon reception of a signal from controller 11 to supply replenishing water for compensation of water loss due to evaporation until the upper limit detecting mechanism of liquid level sensor 9 is activated. Warm washing water 14, or replenishing water supplied via replenishing water supplying pipe 15, is preferably temperature conditioned for both replenishing water for solution preparation and replenishing water for compensation of water loss due to evaporation. Processing baths 1 through 5 are a color developer bath, a bleacher bath, a fixer bath, a washing bath and a stabilizer bath, respectively. The numerical symbol 6 indicates a drying portion.

Figure 2:
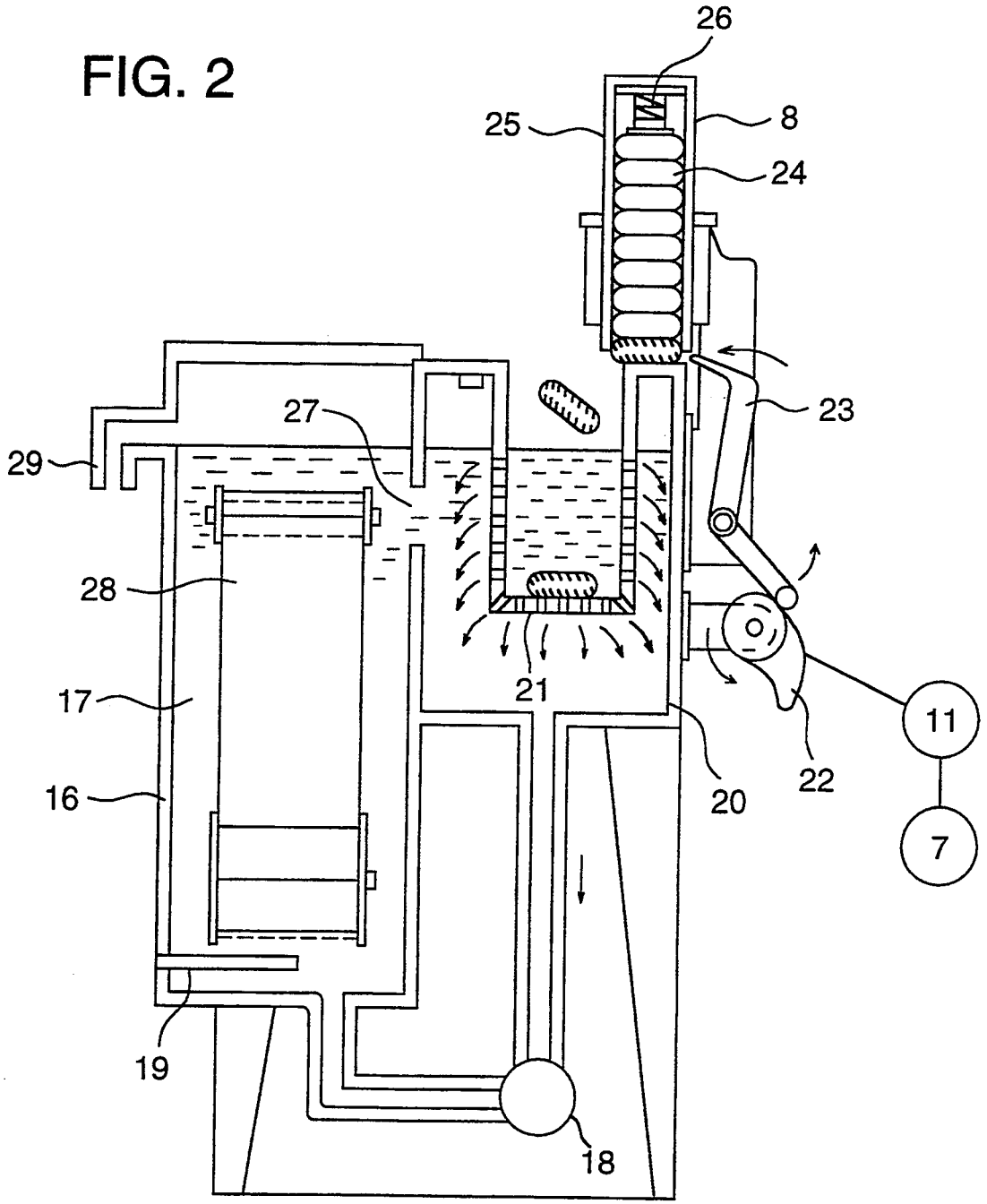
FIG. 2 is a schematic diagram showing an example replenishing agent wherein the replenishing agent is in the form of solid tablets.

FIG. 2 is a schematic diagram showing an example of replenishing agent supplier 18 wherein the replenishing processing agent is in the form of solid tablets.

Upon reception of a signal from light-sensitive material area sensor 7, controller 11 is activated to drive solid processing agent supplying cum 22. Solid replenishing agent pusher claw 23 pushes one to several tablets of solid replenishing agent 24, housed in cartridge 25, into filtering apparatus 21 in subtank 20, where the replenishing agent is dissolved, of each of processing baths 1, 2, 3 and 5. The thus-supplied solid replenishing agent 24 dissolves gradually and is supplied to main processing tank 16 of each of processing baths 1, 2, 3 and 5 by circulatory pump 18. Solubility of replenishing agent 24 can be increased by allowing all or nearly all of the circulatory flow of processing solution 17 circulated between main processing tank 16 and subtank 20 by circulatory pump 18 to directly pass filtering apparatus 21 in subtank 20. In FIG. 2, the numerical symbol 19 denotes a temperature conditioning heater; 26, a pusher claw for retaining replenishing agent 24 in cartridge 25; 27, a communicating pipe between main processing tank 16 and subtank 20 of each of processing baths 1, 2, 3 and 5; 28, a processing rack; 29, an overflow outlet.

Figure 3:
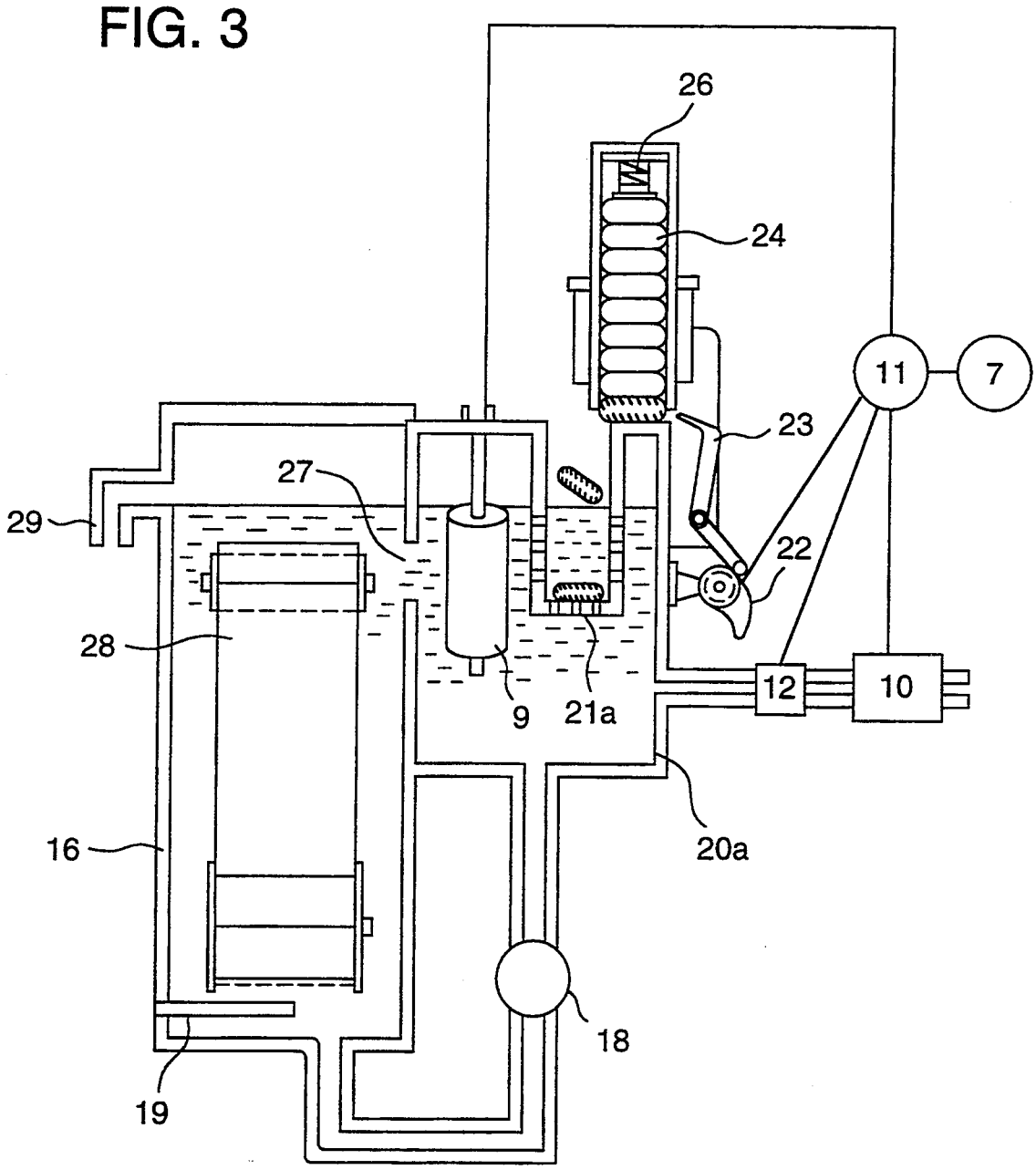
FIG. 3 is a schematic diagram showing an example replenishing water supplier of an automatic processing machine used for the processing method of the present invention.

FIG. 3 is a schematic diagram showing an example of the replenishing water supplier. In this figure as well, replenishing agent 24 is in the form of solid tablets.

Upon reception of a signal from light-sensitive material area sensor 7, controller 11 becomes activated to drive solid replenishing agent supplying cum 22 and solid processing agent pusher claw 23 to supply a solid tablet of replenishing agent 24, while replenishing water supplier 10 and electromagnetic valve 12 are activated to supply replenishing water for solution preparation. The amount of replenishing water for solution preparation is adjusted above the amount required to dissolve replenishing agent 24 by pre-setting the action times of electromagnetic valve 12 and replenishing water supplier 10.

When the liquid level of processing solution 17 in processing baths 1 through 5 has fallen due to evaporation during temperature conditioning or shutdown of the automatic processing machine, liquid level sensor 9 senses the lowered liquid level, passing a signal to controller 11, to drive electromagnetic valve 12 and replenishing water supplier 10 to supply replenishing water for compensation of water loss due to evaporation to the normal liquid level. Upon reach of the normal liquid level, liquid level sensor 9 senses it, passing a signal to controller 11 to disable electromagnetic valve 12 and replenishing water supplier 10.

Standard operating conditions for an automatic processing machine are as follows:

| Process | Temperature | Time |
|---|---|---|
| Color development | 38 ± 0.3° C. | 3 minutes 15 seconds |
| Bleaching | 38 ± 1.0° C. | 45 seconds |
| Fixation 1 | 38 ± 1.0° C. | 45 seconds |
| Fixation 2 | 38 ± 1.0° C. | 45 seconds |
| Stabilization 1 | 38 ± 3.0° C. | 20 seconds |
| Stabilization 2 | 38 ± 3.0° C. | 20 seconds |
| Stabilization 3 | 38 ± 3.0° C. | 20 seconds |
| Drying | 60° C. | 60 seconds |

The stabilizer was supplied by the cascade method wherein it is first supplied to the third tank, an overflow therefrom is allowed to enter the second and then first tank.

Replenishing tablets used

Color Developer Replenishing Tablets

The same procedure as in Example 1 was repeated except that the preservative was changed as shown in Table 12, until 1600 color developer replenishing tablets for color negative films were obtained.

Bleacher replenishing tablets for color negative films

Procedure (5)

237 g of potassium ferric 1,3-propanediaminetetraacetate, 60 g of succinic acid, 73 g of maleic acid and 10 g of 1,3-propanediaminetetraacetic acid were milled and granulated in the same manner as procedure (1). The amount of water added was 5.0 ml. The granulation product was dried at 60° C. for 7 minutes and then dried in a vacuum at 40° C. for 2 hours to remove almost all the water therefrom.

Procedure (6)

100 g of sodium nitrate, 60 g of potassium bromide and 60 g of potassium carbonate were milled and granulated in the same manner as procedure (1). The amount of water added was 1.0 ml. The granulation product was dried at 70° C. for 3 minutes and then dried in a vacuum at 40° C. for 2 hours to remove almost all the water therefrom.

Procedure (7)

The granulation products obtained in the above procedures (5) and (6) were uniformly mixed in a mixer for 10 minutes in a room kept at 25° C. and under 40% RH for moisture conditioning. The resulting mixture was subjected to compressive tableting at a packing rate of 6.0 g per tablet, using a tableting machine, a modification of Tough Press Correct 1527HU, produced by Kikusui Seisakusho, to yield 80 bleacher replenishing tablets for color negative films.

This procedure was repeated until 1500 tablets were obtained.

Fixer replenishing tablets for color negative films

Procedure (8)

950 g of potassium thiosulfate, 2020 g of sodium thiocyanate, 120 g of sodium sulfite, 150 g of potassium carbonate and 10 g of disodium ethylenediaminetetraacetate were milled and granulated in the same manner as procedure (1). The amount of water added was 30 ml. The granulation product was dried at 60° C. for 60 minutes and then dried at 40° C. in a vacuum for 8 hours to remove almost all the water therefrom.

Procedure (9)

The granulation product prepared in the above procedure (8) was uniformly mixed in a mixer for 10 minutes in a room kept at 25° C. and under 40% RH for moisture conditioning. The mixture was subjected to repeated compressive tableting at a packing rate of 13.0 g per tablet, using a tableting machine, a modification of Tough Press Correct 1527HU, produced by Kikusui Seisakusho, to yield 200 bleacher replenishing tablets for color negative films.

This procedure was repeated until 1000 tablets were obtained.

Stabilizer replenishing tablets for color negative films

Procedure (10)

200 g of m-hydroxybenzaldehyde, 10 g of Emulgen 985 and 45 g of potassium carbonate were milled and granulated in the same manner as procedure (1). The amount of water added was 3.0 ml. The granulation product was dried at 30° C. in a vacuum for 8 hours to remove almost all the water therefrom.

Procedure (11)

The granulation product prepared in the above procedure (10) was uniformly mixed in a mixer for 10 minutes in a room kept at 25° C. and under 40% RH for moisture conditioning. The resulting mixture was subjected to repeated compressive tableting at a packing rate of 0.2 g per tablet, using a tableting machine, a modification of Tough Press Correct 1527HU, produced by Kikusui Seisakusho, to yield the desired number of stabilizer replenishing tablets for color negative films.

Processing tank solutions used

1) Color developer tank solution (21.0 l)

To the color developer tank of an automatic processing machine was added 15 l of 35° C. warm water, and 160 tablets of the above-described color developer replenishing tablet agent for color negative films were dissolved. Next, 21 starter tablets having the following composition, separately tableted, were dissolved, after which warm water was added to reach the tank marker line, to yield a tank solution.

Color developing starter for color negative films

| | |
|---|---|
| Sodium bromide | 0.8 g |
| Sodium iodide | 2.0 mg |
| Sodium hydrogen carbonate | 3.0 g |
| Potassium carbonate | 0.5 g |

2) Bleacher (5.0 l)

To the bleacher tank of the automatic processing machine was added 3.0 l of 35° C. warm water, and 350 tablets of the above-described bleacher replenishing tablet agent for color negative films were dissolved, after which 10 starter tablets of the following composition, separately tableted, were added, and warm water was added to reach the tank marker line, to yield a tank solution.

Bleaching starter for color negative films

| | |
|---|---|
| Potassium bromide | 10 g |
| Sodium hydrogen carbonate | 1.5 g |
| Potassium carbonate | 3.5 g |

3) Fixer (4.5 l for first tank, 4.5 l for second tank)

To each of the first and second fixer tanks of the automatic processing machine was added 3.0 l of 35° C. warm water, and 112 tablets of the above-described fixer replenishing tablet agent for color negative films were dissolved, after which warm water was added to reach the tank marker line, to yield a tank solution.

4) Stabilizer (3.2 l for each of first, second and third tanks)

To each of the first, second and third stabilizer tanks of the automatic processing machine was added 3.0 l of 35° C. warm water, and 40 tablets of the above-described stabilizer replenishing tablet agent for color negative film were dissolved, after which warm water was added to reach the tank marker line, to yield a tank solution.

Twenty tablets of each of the replenishing tablet agents described above were set to a replenishing tablet supplier attached to the automatic processing machine, so that two tablets per five rolls of 135-sized 24-shot film processed would be added to the color developer bath and one tablet per two rolls to the other baths, and that replenishing water would be supplied from the water supplier in amounts of 40 ml to the color developer bath, 10 ml to the bleacher bath, 40 ml to the fixer bath and 80 ml to the stabilizer bath.

Running processing was continuously conducted at 0.05 rounds per day until the total amount of color developer replenishing water reached 3 times the capacity of the color developer tank (3 rounds). During this running processing, the automatic processing machine tank was observed for insoluble components. After completion of the running processing, the color printing paper sample was evaluated as to minimum and maximum reflective densities in the unexposed portion, using PDA-65 (produced by Konica Corporation).

The results are given in Table 12.

TABLE 12

| Experiment No. | Preservative | CD-4 concentration in astringent solution | Dmin | | | Dmax | | |
|---|---|---|---|---|---|---|---|---|
| | | | B | G | R | B | G | R |
| 8-1 (comparative) | None | 0.007 | 0.54 | 0.51 | 0.22 | 2.05 | 1.51 | 1.12 |
| 8-2 (comparative) | Hydroxylamine sulfate | 0.013 | 0.66 | 0.59 | 0.27 | 2.75 | 2.23 | 1.71 |
| 8-3 (comparative) | Lactose | 0.008 | 0.55 | 0.53 | 0.24 | 2.13 | 1.60 | 1.26 |
| 8-4 (inventive) | (6) | 0.015 | 0.57 | 0.55 | 0.25 | 3.03 | 2.47 | 1.93 |
| 8-5 (inventive) | (9) | 0.016 | 0.56 | 0.54 | 0.25 | 3.08 | 2.48 | 1.95 |
| 8-6 (inventive) | (10) | 0.016 | 0.56 | 0.55 | 0.26 | 3.05 | 2.50 | 1.92 |
| 8-7 (inventive) | (16) | 0.016 | 0.57 | 0.55 | 0.26 | 3.10 | 2.51 | 1.97 |
| 8-8 (inventive) | (17) | 0.015 | 0.56 | 0.55 | 0.26 | 3.01 | 2.45 | 1.95 |
| 8-9 (inventive) | (26) | 0.016 | 0.58 | 0.55 | 0.25 | 3.03 | 2.50 | 1.93 |
| 8-10 (inventive) | (27) | 0.015 | 0.58 | 0.55 | 0.27 | 3.09 | 2.49 | 1.99 |
| 8-11 (inventive) | (61) | 0.015 | 0.56 | 0.54 | 0.27 | 3.11 | 2.45 | 1.93 |
| 8-12 (inventive) | (63) | 0.016 | 0.56 | 0.54 | 0.26 | 3.08 | 2.48 | 1.95 |
| 8-13 (inventive) | (64) | 0.016 | 0.57 | 0.56 | 0.27 | 3.05 | 2.47 | 1.94 |

From Table 12, it is seen that addition of the monosaccharide of the present invention as a preservative ensures good processing performance without increase in the density of light transmitted in the $D_{min}$ portion.

Example 9

After exposure by a conventional method, samples as described in Japanese Patent Application No. 47516/1990 were subjected to a running processing test using the following automatic processing machine and processing agents.

Automatic processing machine

Using Konica color paper type QA processor CL-PP-718, modified to have tablet supplying, liquid level detecting and warm water supplying functions, processing experiments were conducted under the following conditions:

Processing conditions 1

| Process | Temperature | Time (seconds) | Replenishing rate |
|---|---|---|---|
| Color development | 35 ± 0.3° C. | 45 | See Table 13 |
| Bleach-fixation | 35 ± 1.0° C. | 45 | 249 ml/m$^2$ |
| Stabilization 1 | 35 ± 3.0° C. | 30 | |
| Stabilization 2 | 35 ± 3.0° C. | 30 | |
| Stabilization 3 | 35 ± 3.0° C. | 30 | 249 ml/m$^2$ |
| Drying | 72 ± 5.0° C. | 40 | |

Processing conditions 2

| Process | Temperature | Time (seconds) | Replenishing rate |
|---|---|---|---|
| Color development | 38 ± 0.3° C. | 27 | See Table 13 |

-continued

| Process | Temperature | Time (seconds) | Replenishing rate |
|---|---|---|---|
| Bleach-fixation | 38 ± 1.0° C. | 27 | 249 ml/m$^2$ |
| Stabilization 1 | 38 ± 3.0° C. | 30 | |
| Stabilization 2 | 38 ± 3.0° C. | 30 | |
| Stabilization 3 | 38 ± 3.0° C. | 30 | 249 ml/m$^2$ |
| Drying | 72 ± 5.0° C. | 40 | |

The stabilizer was supplied by the cascade method wherein it is first supplied to the third tank, an overflow therefrom is allowed to enter the second and then first tank.

Replenishing tablets used

Color Developer Replenishing Tablets (I)

The same procedure as in Example 1 was repeated except that the weight ratio of the color developing agent CD-3 was changed as shown in Table 13, until 1000 color developer replenishing tablets for color printing paper were obtained.

Color Developer Replenishing Tablets (II)

Procedure (A')

The developing agent CD-3 [4-amino-3-methyl-N-ethyl-N-[β-(methanesulfonamido)ethyl]aniline sulfate] was milled in an air jet mill to a final average grain size of 10 μm. The fine powder thus obtained was granulated in a commercially available fluidized bed spray granulator at room temperature for about 5 minutes, while adding 4.0 ml of water. The granulation product was dried at 60° C. for 10 minutes and then dried at 40° C. in a vacuum for 2 hours to remove almost all the water therefrom. The amount of CD-3 was adjusted so that its weight ratio would be each value shown in Table 13.

Procedure (B')

0.26 mol of each of the compounds listed in Table 13 was milled and granulated in the same manner as procedure (A'). The amount of water added was 2.0 ml. The granulation product was dried at 60° C. for 10 minutes and then dried in a vacuum at 40° C. for 2 hours to remove almost all the water therefrom.

Procedure (C')

19 g of Tinopal SFP (produced by Ciba-Geigy), 1.3 g of sodium sulfite, 256 g of potassium carbonate, 0.3 g of potassium bromide, 19 g of diethylenetriaminepentaacetic acid and 128 g of polyethylene glycol (average molecular weight 6000) were milled in the same manner as procedure (A') and then uniformly mixed in a commercially available mixer. Then, the mixture was granulated in the same manner as procedure (A'), while adding 150 ml of water. The granulation product was dried at 65° C. for 15 minutes and then dried at 40° C. in a vacuum for 2 hours to remove almost all the water therefrom.

Procedure (D')

The granulation products prepared in the above procedures (A') through (C') were uniformly mixed for 10 minutes using a mixer in a room kept at 25° C. and under 40% RH for moisture conditioning. The resulting mixture was subjected to compressive tableting, using a tableting machine, a modification of Tough Press Correct 1527HU, produced by Kikusui Seisakusho, to yield 100 color developer replenishing tablets color for color printing paper.

This procedure was repeated until 1000 color developer replenishing tablets were obtained.

Color Developer Replenishing Tablets (III)

Procedure (A")

The developing agent CD-3 [4-amino-3-methyl-N-ethyl-N-[β-(methanesulfonamido)ethyl]aniline sulfate] was milled in an air jet mill to a final average grain size of 10 μm. The fine powder thus obtained was granulated in a commercially available fluidized bed spray granulator at room temperature for about 5 minutes, while adding 4.0 ml of water. The granulation product was dried at 60° C. for 10 minutes and then dried in a vacuum at 40° C. for 2 hours to remove almost all the water therefrom. The amount of CD-3 was adjusted so that its weight ratio would be each value shown in Table 13.

Procedure (B")

0.13 mol of each of the compounds listed in Table 13 was milled and granulated in the same manner as procedure (A"). The amount of water added was 1.0 ml. The granulation product was dried at 60° C. for 10 minutes and then dried in a vacuum at 40° C. for 2 hours to remove almost all the water therefrom.

Procedure (C")

10 g of Tinopal SFP (produced by Ciba-Geigy), 0.6 g of sodium sulfite, 128 g of potassium carbonate, 0.17 g of potassium bromide, 10 g of diethylenetriaminepentaacetic acid and 67 g of polyethylene glycol (average molecular weight 6000) were milled in the same manner as procedure (A") and then uniformly mixed in a commercially available mixer. Then, the mixture was granulated in the same manner as procedure (A") , while adding 100 ml of water. The granulation product was dried at 65° C. for 15 minutes and then dried in a vacuum at 40° C. for 2 hours to remove almost all the water therefrom.

Procedure (D")

The granulation products prepared in the above procedures (A") through (C") were uniformly mixed in a mixer for 10 minutes in a room kept at 25° C. and under 40% RH for moisture conditioning. The resulting mixture was subjected to compressive tableting, using a tableting machine, a modification of Tough Press Correct 1527HU, produced by Kikusui Seisakusho, to yield 100 color developer replenisher tablets color for color printing paper.

This procedure was repeated until 1000 color developer replenisher tablets were obtained.

Bleach-fixer replenisher tablets

Procedure (E)

550 g of potassium ferric ethylenediaminetetraacetate monohydrate and 20 g of ethylenediaminetetraacetic acid were milled and granulated in the same manner as procedure (A). The amount of water added was 25.0 ml. The granulation product was dried at 60° C. for 10 minutes and then dried at 40° C. in a vacuum for 2 hours to remove almost all the water therefrom.

Procedure (F)

1770 g of ammonium thiosulfate, 200 g of sodium sulfite, 60 g of potassium bromide and 20 g of p-toluenesulfinic acid were milled and granulated in the same manner as procedure (A). The amount of water added was 15.0 ml. The granulation product was dried at 60° C. for 10 minutes and then dried at 40° C. in a vacuum for 2 hours to remove almost all the water therefrom.

Procedure (G)

The granulation products obtained in the above procedures (E) and (F) were uniformly mixed in a mixer for 10 minutes in a room kept at 25° C. and under 40% RH for moisture conditioning. The resulting mixture was subjected to repeated compressive tableting at a packing rate of 21.3 g per tablet, using a tableting machine, a modification of Tough Press Correct 1527HU, produced by Kikusui Seisakusho, to yield 100 bleach-fixer replenishing tablets for color printing paper.

This procedure was repeated until 1200 bleach-fixer replenishing tablets were obtained.

Stabilizer replenishing tablets for color printing paper

Procedure (H)

10 g of potassium carbonate and 200 g of sodium 1-hydroxyethane-1,1-diphosphonate were milled and granulated in the same manner as procedure (A). The amount of water added was 1.0 ml. The granulation product was dried at 70° C. for 3 minutes and then dried in a vacuum at 40° C. for 2 hours to remove almost all the water therefrom.

Procedure (I)

150 g of Tinopal SFP (produced by Ciba-Geigy), 300 g of sodium sulfite, 20 g of zinc sulfate heptahydrate and 150 g of ethylenetriaminepentaacetic acid were milled and granulated in the same manner as procedure (A). The amount of water added was 10.0 ml. The granulation product was dried at 65° C. for 5 minutes and then dried in a vacuum at 40° C. for 8 hours to remove almost all the water therefrom.

Procedure (J)

The granulation products obtained in the above procedures (H) and (I) were uniformly mixed in a mixer for 10 minutes in a room kept at 25° C. and under 40% RH for moisture conditioning. The resulting mixture was subjected to repeated compressive tableting at a packing rate of 0.66 g per tablet, using a tableting machine, a modification of Tough Press Correct 1527HU, produced by Kikusui Seisakusho, to yield 100 stabilizer replenishing tablets for color printing paper.

This procedure was repeated until 800 stabilizer replenishing tablets were obtained.

Processing tank solutions used

Color Developer Tank Solution (23.0 l)

To the color developer tank of an automatic processing machine was added 18 l of 35° C. warm water, and 161 tablets of the above-described color developer replenishing tablet agent for color printing paper were dissolved. Next, 23 starter tablets having the following composition, separately tableted, were dissolved, after which warm water was added to reach the tank marker line, to yield a tank solution.

Color developing starter for color printing paper

| | |
|---|---|
| Potassium chloride | 4.0 g |
| Potassium hydrogen carbonate | 4.8 g |
| Potassium carbonate | 2.1 g |

Bleach-fixer (23.0 l)

To the bleach-fixer tank of the automatic processing machine was added 15 l of 35° C. warm water, and 292 tablets of the above-described bleacher replenishing tablet agent for color printing paper were dissolved, after which warm water was added to reach the tank marker line, to yield a tank solution.

Stabilizer (15 l for each of first, second and third tanks)

To each of the first, second and third stabilizer tanks of the automatic processing machine was added 12 l of 35° C. warm water, and 60 tablets of the above-described stabilizer replenishing tablet agent for color printing paper were dissolved, after which warm water was added to reach the tank marker line, to yield a tank solution.

Twenty tablets of each replenisher tablet agent were set to a replenisher tablet supplier attached to the automatic processing machine so that one tablet would be added to the color developing bath per 8000 $m^2$ of color printing paper processed or to each of the bleach-fixer bath and stabilizing bath per 3200 $cm^2$ of color printing paper processed, and that water would be supplied from the warm water supplier in each amount specified in Table 13 to the color developing bath and 250 ml per $m^2$ of color printing paper processed to each of the bleaching and stabilizing baths.

Running processing was continuously conducted at 0.05 rounds per day until the total amount of color developer replenishing water reached 3 times the capacity of the color developer tank (3 rounds). After completion of the running processing, the color printing paper sample was evaluated as to minimum and maximum reflective densities in the unexposed portion, using PDA-65 (produced by Konica Corporation). The results are given in Table 14.

TABLE 13

| Experiment No. | Preservative | Color developer replenishing tablet agent | Color developer replenishing rate (ml/$m^2$) | CD-3 weight ratio (%) in tablets | CD-3 concentration in astringent solution (mol/l) |
|---|---|---|---|---|---|
| 9-1 (comp.) | Lactose | (I) | 125 | 8 | 0.004 |
| 9-2 (comp.) | | | | 10 | 0.007 |
| 9-3 (comp.) | | | | 12 | 0.008 |
| 9-4 (comp.) | | | | 15 | 0.010 |
| 9-5 (comp.) | | (II) | 80 | 8 | 0.002 |
| 9-6 (comp.) | | | | 10 | 0.004 |
| 9-7 (comp.) | | | | 12 | 0.006 |
| 9-8 (comp.) | | | | 15 | 0.008 |
| 9-9 (comp.) | | (III) | 40 | 8 | 0 |
| 9-10 (comp.) | | | | 10 | 0 |
| 9-11 (comp.) | | | | 12 | 0.001 |
| 9-12 (comp.) | | | | 15 | 0.003 |
| 9-13 (comp.) | | | | 18 | 0.008 |
| 9-14 (inv.) | (9) | (I) | 125 | 8 | 0.009 |
| 9-15 (inv.) | | | | 10 | 0.013 |
| 9-16 (inv.) | | | | 12 | 0.016 |
| 9-17 (inv.) | | | | 15 | 0.022 |
| 9-18 (inv.) | | (II) | 80 | 8 | 0.006 |
| 9-19 (inv.) | | | | 10 | 0.010 |
| 9-20 (inv.) | | | | 12 | 0.015 |
| 9-21 (inv.) | | | | 15 | 0.020 |
| 9-22 (inv.) | | (III) | 40 | 8 | 0 |
| 9-23 (inv.) | | | | 10 | 0.001 |
| 9-24 (inv.) | | | | 12 | 0.005 |

TABLE 13-continued

| Experiment No. | Preservative | Color developer replenishing tablet agent | Color developer replenishing rate (ml/m$^2$) | CD-3 weight ratio (%) in tablets | CD-3 concentration in astringent solution (mol/l) |
|---|---|---|---|---|---|
| 9-25 (inv.) | | | | 15 | 0.009 |
| 9-26 (inv.) | | | | 18 | 0.019 |

comp.: comparative
inv.: inventive

TABLE 14

| | Processing conditions 1 | | | | | | Processing conditions 2 | | | | | |
|---|---|---|---|---|---|---|---|---|---|---|---|---|
| | Dmin | | | Dmax | | | Dmin | | | Dmax | | |
| Experiment No. | B | G | R | B | G | R | B | G | R | B | G | R |
| 9-1 (comparative) | 0.08 | 0.08 | 0.05 | 0.70 | 0.13 | 1.38 | 0.07 | 0.08 | 0.05 | 0.48 | 0.81 | 1.19 |
| 9-2 (comparative) | 0.09 | 0.08 | 0.05 | 1.40 | 2.30 | 2.48 | 0.09 | 0.09 | 0.05 | 1.12 | 2.08 | 2.23 |
| 9-3 (comparative) | 0.11 | 0.09 | 0.06 | 1.50 | 2.43 | 2.58 | 0.10 | 0.09 | 0.05 | 1.33 | 2.22 | 2.36 |
| 9-4 (comparative) | 0.12 | 0.09 | 0.06 | 2.08 | 2.60 | 2.66 | 0.12 | 0.09 | 0.06 | 1.60 | 2.48 | 2.53 |
| 9-5 (comparative) | 0.09 | 0.08 | 0.05 | 0.50 | 0.65 | 0.75 | 0.08 | 0.07 | 0.05 | 0.25 | 0.40 | 0.60 |
| 9-6 (comparative) | 0.11 | 0.09 | 0.06 | 0.63 | 1.10 | 1.35 | 0.11 | 0.08 | 0.05 | 0.41 | 0.88 | 1.17 |
| 9-7 (comparative) | 0.13 | 0.10 | 0.07 | 1.30 | 2.18 | 2.40 | 1.13 | 0.10 | 0.06 | 0.92 | 1.98 | 2.22 |
| 9-8 (comparative) | 0.15 | 0.11 | 0.07 | 1.52 | 2.33 | 2.51 | 0.15 | 0.11 | 0.07 | 1.38 | 2.21 | 2.43 |
| 9-9 (comparative) | 0.11 | 0.09 | 0.06 | 0.12 | 0.10 | 0.06 | 0.11 | 0.09 | 0.07 | 0.12 | 0.11 | 0.06 |
| 9-10 (comparative) | 0.13 | 0.10 | 0.08 | 0.15 | 0.13 | 0.09 | 0.12 | 0.10 | 0.08 | 0.16 | 0.13 | 0.10 |
| 9-11 (comparative) | 0.15 | 0.12 | 0.09 | 0.32 | 0.52 | 0.60 | 0.14 | 0.11 | 0.09 | 0.25 | 0.45 | 0.55 |
| 9-12 (comparative) | 0.16 | 0.13 | 0.09 | 0.50 | 0.98 | 1.22 | 0.16 | 0.13 | 0.10 | 0.40 | 0.78 | 1.05 |
| 9-13 (comparative) | 0.17 | 0.14 | 0.10 | 1.45 | 2.25 | 2.40 | 0.17 | 0.14 | 0.11 | 1.13 | 2.05 | 2.28 |
| 9-14 (inventive) | 0.02 | 0.04 | 0.03 | 1.85 | 2.55 | 2.65 | 0.02 | 0.04 | 0.03 | 1.55 | 2.45 | 2.60 |
| 9-15 (inventive) | 0.03 | 0.04 | 0.03 | 2.18 | 2.65 | 2.73 | 0.02 | 0.04 | 0.04 | 1.83 | 2.56 | 2.71 |
| 9-16 (inventive) | 0.02 | 0.05 | 0.03 | 2.20 | 2.63 | 2.75 | 0.03 | 0.04 | 0.03 | 2.18 | 2.62 | 2.74 |
| 9-17 (inventive) | 0.02 | 0.04 | 0.03 | 2.21 | 2.67 | 2.78 | 0.03 | 0.04 | 0.03 | 2.22 | 2.66 | 2.77 |
| 9-18 (inventive) | 0.02 | 0.04 | 0.03 | 1.35 | 2.25 | 2.45 | 0.02 | 0.04 | 0.04 | 0.90 | 2.01 | 2.25 |
| 9-19 (inventive) | 0.03 | 0.04 | 0.03 | 1.80 | 2.50 | 2.60 | 0.03 | 0.04 | 0.03 | 1.57 | 2.40 | 2.62 |
| 9-20 (inventive) | 0.03 | 0.04 | 0.03 | 2.22 | 2.63 | 2.78 | 0.04 | 0.04 | 0.03 | 2.16 | 2.63 | 2.73 |
| 9-21 (inventive) | 0.04 | 0.06 | 0.03 | 2.23 | 2.66 | 2.79 | 0.04 | 0.05 | 0.04 | 2.20 | 2.65 | 2.75 |
| 9-22 (inventive) | 0.02 | 0.04 | 0.03 | 0.03 | 0.04 | 0.04 | 0.02 | 0.04 | 0.03 | 0.03 | 0.04 | 0.04 |
| 9-23 (inventive) | 0.02 | 0.04 | 0.03 | 0.35 | 0.50 | 0.65 | 0.03 | 0.04 | 0.03 | 0.27 | 0.40 | 0.55 |
| 9-24 (inventive) | 0.03 | 0.04 | 0.04 | 0.78 | 1.20 | 1.43 | 0.03 | 0.04 | 0.04 | 0.51 | 1.80 | 2.03 |
| 9-25 (inventive) | 0.03 | 0.04 | 0.04 | 1.70 | 2.50 | 2.53 | 0.05 | 0.05 | 0.04 | 1.30 | 2.20 | 2.45 |
| 9-26 (inventive) | 0.04 | 0.06 | 0.04 | 2.18 | 2.63 | 2.75 | 0.05 | 0.06 | 0.04 | 2.13 | 2.63 | 2.74 |

From Tables 13 and 14, it is seen that use of the preservative monosaccharide of the present invention offers good processing performance without increasing the minimum reflective density in the unexposed portion, while increasing the CD-3 weight ratio in tablets makes possible rapider processing and waste liquid volume reduction.

According to the present invention, the following effects 1) through 5) are achieved in silver halide color photographic light-sensitive material solid photographic color developing compositions and processing methods for silver halide color photographic light-sensitive materials.

1) Solid processing agent storage stability and solubility improve.

2) Staining in photographic processing is prevented.

3) Photographic performance stability during processing improves.

4) Socio-environmental conservation is facilitated by reduction in package wastes and reduction in waste liquid volume as a result of replenishing rate reduction.

5) For tablets, excellent storage stability and solubility can be retained even when they are prepared as a single-part agent.

What is claimed is:

1. A solid photographic color developing composition comprising a photographic color developing agent and at least one of monosaccharides.

2. The solid photographic color developing composition of claim 1, wherein the form of the solid photographic color developing composition is selected from tablet form, granule form or powder form.

3. The solid photographic color developing composition of claim 1, wherein the form of the photographic color developing composition is a tablet form.

4. The solid photographic color developing composition of claim 1, wherein the solid photographic color developing composition contains all component necessary for a color development of a silver halide color photographic light-sensitive material.

5. The solid photographic color developing composition of claim 1, wherein the solid photographic color developing composition contains substantially no hydroxylamine or salt thereof.

6. The solid photographic color developing composition of claim 1, wherein the photographic color developing agent comprises a p-phenylenediamine type color developing agent, and the addition amount of the p-phenylenediamine type color developing agent is not less than 10% by weight of the solid photographic color developing composition.

7. The solid photographic color developing composition of claim 6, wherein said color developing agent is a p-phenylene diamine having a water-soluble group selected from the group consisting of $-(CH_2)_n-CH_2OH$, $-(CH_2)_m-NHSO_2-(CH_2)_n-CH_3$, $-(CH_2)_m-O-(CH_2)_n-CH_3$, $-(CH_2CH_2O)_nC_mH_{2m+1}$ $$-(CH_2)_m-CON\begin{matrix}C_mH_{2m+1}\\C_mH_{2m+1}\end{matrix}$$

(m and n independently represent an integer of not less than 0) , —COOH, and —$SO_3H$.

8. The solid photographic color developing composition of claim 7, wherein the photographic color developing agent is 4-amino-N-ethyl-N-(β-methanesulfonamidoethyl)-m-toluidine sesquisulfate hydrate.

9. The solid photographic color developing composition of claim 6, wherein a concentration of the p-phenylenediamine type color developing agent is not less than $1.5\times10^{-2}$ mol per 1 l of a color developing solution.

* * * * *